US006910228B2

(12) United States Patent
Tanaka

(10) Patent No.: US 6,910,228 B2
(45) Date of Patent: Jun. 28, 2005

(54) HELMET

(75) Inventor: Haruo Tanaka, Ichikawa (JP)

(73) Assignee: Shoei, Co., Ltd., Tokyo (JP)

( * ) Notice: Subject to any disclaimer, the term of this patent is extended or adjusted under 35 U.S.C. 154(b) by 0 days.

(21) Appl. No.: 10/480,317

(22) PCT Filed: May 31, 2002

(86) PCT No.: PCT/JP02/05384

§ 371 (c)(1),
(2), (4) Date: Dec. 11, 2003

(87) PCT Pub. No.: WO02/100204

PCT Pub. Date: Dec. 19, 2002

(65) Prior Publication Data

US 2004/0158914 A1 Aug. 19, 2004

(30) Foreign Application Priority Data

Jun. 12, 2001 (JP) ..... 2001-177205

(51) Int. Cl.[7] ..... A42B 1/08
(52) U.S. Cl. ..... 2/424; 2/171.3
(58) Field of Search ..... 2/424, 410, 425, 2/171.3, 422, 171.4, 184.5, 171.7

(56) References Cited

U.S. PATENT DOCUMENTS 3,496,854 A * 2/1970 Hill et al. ..... 454/370
5,093,938 A 3/1992 Kamata
5,165,116 A * 11/1992 Simpson ..... 2/424
5,345,614 A * 9/1994 Tanaka ..... 2/425
5,937,446 A * 8/1999 Fallert ..... 2/412
6,263,513 B1 * 7/2001 Murakami ..... 2/171.3

FOREIGN PATENT DOCUMENTS

EP 252243 A1 * 1/1988 ..... A42B/3/00
EP 320622 A2 * 6/1989 ..... A42B/3/02
JP 10-245712 9/1998
JP 10245712 A * 9/1998 ..... A42B/3/28

* cited by examiner

*Primary Examiner*—Rodney M. Lindsey
(74) *Attorney, Agent, or Firm*—Jones Day

(57) ABSTRACT

A stabilizer constituting member or ventilation opening forming member 51 having a stabilizer portion or ventilation opening forming portion 61, which has an air current deflection surface 63 gradually separating from an outer surface of a head protecting body in the range of the front end to the rear end of the stabilizer portion or ventilation opening forming portion 61, is disposed on an outer side of the head protecting body. According to one aspect, exhaust openings 55*a* to 55*c* are formed in a step surface 64 extending from near the rear end of the air current deflection surface 63 substantially toward the outer surface of the head protecting body. According to another aspect, the ventilation opening forming member 51 further has air current divider portions 62*a* and 62*b* having exhaust openings 54*a* and 54*b* surrounded by substantially two-way forked projecting ridges 66, respectively.

Thus, air in the head protecting body can be effectively discharged from the exhaust openings 55*a* to 55*c* and/or 54*a* and 54*b*. According to the other aspect, the traveling stability of the head protecting body can be achieved.

41 Claims, 17 Drawing Sheets

HELMET

TECHNICAL FIELD

The present invention relates to a helmet which comprises a head protecting body to be worn on the head of a helmet wearer (to be merely referred to as a "wearer" hereinafter) such as the rider of a motor cycle to protect his/her head, and in which a ventilator mechanism for ventilation of the interior of the head protecting body and the like is provided to the head protecting body.

BACKGROUND ART

As a full-face-type helmet having a ventilator mechanism in its head protecting body for the purpose of ventilation of the interior of the head protecting body or fogging prevention of the inner surface of a shield plate, for example, one described in U.S. Pat. No. 5,093,938 is conventionally known.

The full-face-type helmet (to be merely referred to as "the conventional helmet" hereinafter). described in U.S. Pat. No. 5,093,938 has a forehead ventilator mechanism and chin ventilator mechanism above and under a window opening, which is formed in a full-face-type head protecting body to be worn on the head of the wearer, to oppose the face of the wearer. The forehead ventilator mechanism and chin ventilator mechanism have a forehead air supply hole and chin air supply hole, respectively. The forehead and chin air supply holes can be opened/closed by a forehead shutter member and chin shutter member, respectively.

Hence, in the conventional helmet, when the forehead air supply hole is opened, the outer air can be introduced into the head protecting body (i.e., the internal texture of the head protecting body itself and/or the head accommodating space of the head protecting body), to perform ventilation of the interior of the head protecting body. When the chin air supply hole is opened and the outer air is introduced into the head protecting body near the lower end of the inner surface of the shield plate, the introduced outer air moves up along the inner surface of the shield plate, to prevent fogging of the shield plate.

In the conventional helmet with the above arrangement, however, the outer air introduced into the head protecting body through the forehead air supply hole merely diffuses naturally over a wide range in the head protecting body, and draft for ventilation of the interior of the head protecting body and the like cannot be performed effectively. The outer air introduced into the head protecting body near the lower end of the inner surface of the shield plate through the chin air supply hole not only drifts upward along the inner surface of the shield plate, but its considerable portion naturally diffuses over a wide range in the head protecting body. Thus, fogging of the shield plate cannot be prevented well.

Therefore, with the conventional helmet, when it rains and the humidity is very high, ventilation of the interior of the head protecting body and fogging prevention of the shield plate cannot be performed effectively.

The present invention aims at effectively correcting the drawbacks of the conventional helmet described above with a comparatively simple arrangement.

DISCLOSURE OF INVENTION

According to the first aspect of the present invention, the present invention relates to a helmet comprising a head protecting body to be worn on a head of a helmet wearer, the head protecting body having a ventilator mechanism, wherein a stabilizer constituting member having a stabilizer portion is disposed on an outer side of the head protecting body, the stabilizer portion having an air current deflection surface which gradually separates from an outer surface of the head protecting body in a range of a front end to a rear end of the stabilizer portion, and a step surface extending from near the rear end of the air current deflection surface substantially toward the outer surface of the head protecting body, and a ventilation opening serving as an exhaust opening of the ventilation mechanism is formed in the step surface.

According to the second aspect of the present invention, the present invention relates to a helmet comprising a head protecting body to be worn on a head of a helmet wearer, the head protecting body having a ventilator mechanism, wherein a stabilizer constituting member commonly having a stabilizer portion and an air current divider portion provided independently of the stabilizer portion is disposed on an outer side of the head protecting body, the stabilizer portion having an air current deflection surface which gradually separates from an outer surface of the head protecting body in a range of a front end to a rear end of the stabilizer portion, and the air current divider portion having a substantially two-way forked projecting ridge such as a substantially V-shaped or substantially U-shaped projecting ridge, and a ventilation opening which is surrounded by the substantially two-way forked projecting ridge and serves as an exhaust opening of the ventilator mechanism. In the second aspect of the present invention, according to the first embodiment, the stabilizer portion further has a step surface extending from near a rear end of the air current deflection surface substantially toward the outer surface of the head protecting body, and a second ventilation opening serving as a second exhaust opening of the ventilation mechanism is formed in the step surface.

According to the third aspect of the present invention, the present invention relates to a helmet comprising a head protecting body to be worn on a head of a helmet wearer, the head protecting body having a ventilator mechanism, wherein a ventilation opening forming member commonly having a ventilation opening forming portion and an air current divider portion provided independently of the ventilation opening forming portion is disposed on an outer side of the head protecting body, the ventilation opening forming portion having an air current deflection surface which gradually separates from an outer surface of the head protecting body in a range of a front end to a rear end of the ventilation opening forming portion, and a step surface extending from near the rear end of the air current deflection surface substantially toward the outer surface of the head protecting body, and the air current divider portion having a substantially two-way forked projecting ridge such as a substantially V-shaped or substantially U-shaped projecting ridge, and a ventilation opening which is surrounded by the substantially two-way forked projecting ridge and serves as an exhaust opening of the ventilator mechanism, and a second ventilation opening serving as a second exhaust opening of the ventilator mechanism is formed in the step surface.

In the first embodiment of the second aspect of the present invention and the third aspect of the present invention, according to the second embodiment of the second aspect and the first embodiment of the third aspect, first and second ventilation openings may be formed in an outer shell of the head protecting body, and the helmet may further comprise at least one first exhaust path extending from the first ventilation opening of the outer shell to the ventilation opening of the air current divider portion, and at least one second exhaust path extending from the second ventilation opening of the outer shell to the second ventilation opening in the step surface, and a shutter mechanism which can commonly open and close at least one first exhaust path and at least one second exhaust path. In the second embodiment of the second aspect and the first embodiment of the third aspect of the present invention, according to the third embodiment of the second aspect and the second embodiment of the third aspect, the first exhaust path can comprise a pair of left and right first exhaust paths and the second exhaust path can comprise a pair of left and right second exhaust paths, and the shutter mechanism can commonly open and close the pair of left and right first exhaust paths and the pair of left and right second exhaust paths. Furthermore, in the first embodiment of the second aspect and the third aspect of the present invention, according to the fourth embodiment of the second aspect and the third embodiment of the third aspect, first and second ventilation openings may be formed in an outer shell of the head protecting body, and the helmet may further comprise a first exhaust path extending from the first ventilation opening of the outer shell to the second ventilation opening of the step surface, and a second exhaust path extending from the second ventilation opening of the outer shell to the ventilation opening of the air current divider portion, and no shutter mechanism that can open and close the first exhaust path, but a shutter mechanism that can open and close the second exhaust path.

According to the first aspect of the present invention, a ventilation opening serving as an exhaust opening of the ventilator mechanism is formed in the step surface of the stabilizer portion, and the step surface having the ventilator opening extends from near a rear end of the air current deflection surface substantially toward the outer surface of the head protecting body. Accordingly, the outer side of the exhaust opening is at a negative pressure, so that air in the head protecting body can be discharged well to the outside from the ventilation opening. Air in the head protecting body can be effectively discharged to the outside from the exhaust opening with a relatively simple structure.

According to the first and second aspects of the present invention, the traveling wind flowing along the outer surface of the head protecting body is forcibly separated from the outer surface of the head protecting body by the air current deflection surface of the stabilizer portion, and shifts relatively backward while it maintains a substantially laminar state. As the amount of traveling wind abruptly detouring to the rear portion of the head protecting body can be decreased, the drag and lift with respect to the head protecting body can be decreased. As a result, the traveling stability of the head protecting body can be achieved with a comparatively simple arrangement.

According to the second and third aspects of the present invention, the ventilation opening of the air current divider portion which serves as the exhaust opening of the ventilator mechanism is surrounded by the substantially two-way forked projecting ridge. Thus, the outer side of the ventilation opening is at a negative pressure, so that air in the head protecting body can be discharged well to the outside from the ventilation opening.

According to the first embodiment of the second aspect and the third aspect of the present invention, in addition to the ventilation opening of the air current divider portion which serves as the first exhaust opening of the ventilator mechanism, a second ventilation opening serving as a second exhaust opening of the ventilator mechanism is formed in the step surface of the stabilizer portion or ventilation opening forming portion, and the step surface having the ventilator opening extends from near a rear end of the air current deflection surface substantially toward the outer surface of the head protecting body. Accordingly, the outer side of the second exhaust opening is also at a negative pressure, so that air in the head protecting body can be discharged well to the outside from the second ventilation opening as well. Air in the head protecting body can be discharged to the outside more effectively from the two types of exhaust openings (i.e., first and second exhaust openings) with a relatively simple structure.

Furthermore, according to the second embodiment of the second aspect and the first embodiment of the third aspect of the present invention, the first exhaust path having the first exhaust opening as the terminal end and the second exhaust path having the second exhaust opening as the terminal end can be commonly opened and closed by a common shutter mechanism. Hence, these two types of exhaust paths (i.e., first and second exhaust paths) can be opened and closed easily.

According to the third embodiment of the second aspect and the second embodiment of the third aspect of the present invention, each of the first and second exhaust paths has a pair of left and right exhaust paths. Therefore, air in the head protecting body can be discharged to the outside more effectively. The pair of left and right first exhaust paths and the pair of left and right second exhaust paths can be commonly opened and closed by the common shutter mechanism. Therefore, these two types of exhaust paths, amounting to a total of four, can be opened and closed very easily.

According to the fourth embodiment of the second aspect and the third embodiment of the third aspect of the present invention, the arrangement and operation of the shutter mechanism can be simplified.

BEST MODE OF CARRYING OUT THE INVENTION

Figure 1:
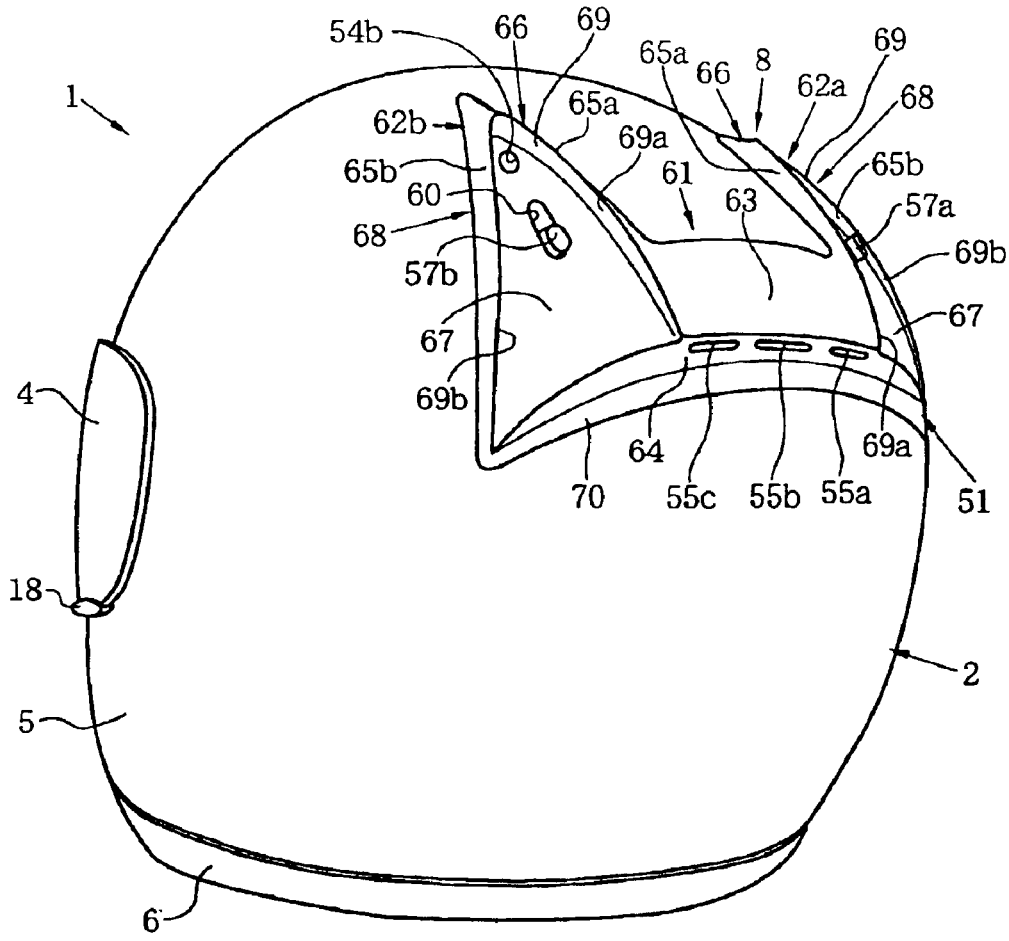
FIG. 1 is a perspective view, seen from obliquely behind the upper right, of the entire portion of a helmet according to the first embodiment in which the present invention is applied to a full-face-type helmet.

The first, second and third embodiments in which the present invention is applied to a full-face-type helmet will be sequentially described separately with reference to the drawings.

1. First Embodiment

The first embodiment will be sequentially described separately into "entire helmet", "impact-on-the-head and impact-on-the-chin-and-cheek absorbing liners", "forehead and chin ventilator mechanisms" and "back head side ventilator mechanism" with reference to FIGS. 1 to 10.

(1) Entire Helmet

As shown in FIGS. 1 to 4, a full-face-type helmet 1 is made up of a full-face-type cap-like head protecting body 2 to be worn on the head of a wearer, a shield plate 4 capable of opening/closing a window opening 3 which is formed in the front surface of the head protecting body 2 to oppose that portion (i.e., the face) of the wearer, which is between the forehead and chin, and a pair of left and right chin straps (not shown in FIGS. 1 to 4 as they are accommodated in the head protecting body 2 and can be conventional ones) attached to the inner side of the head protecting body 2. A forehead ventilator mechanism 9 is formed at at least a part of the forehead region of the head protecting body 2, which opposes the forehead of the wearer, and the vicinity of the forehead region. A chin ventilator mechanism 10 is formed at at least a part of the chin region of the head protecting body 2, which opposes the chin of the wearer, and the vicinity of the chin region. A back head side ventilator mechanism 8 is formed at at least a part of the vertex region (i.e., its front and rear portions) and the upper portion of the occiput region of the head protecting body 2, which correspond to the vertex part (i.e., its front and rear portions) and the upper portion of the occiput part of the head of the wearer, and their vicinities. In this specification, the front and rear portions of each of the vertex part of the head and the vertex region indicate the front and rear portions obtained when each of the vertex part of the head and the vertex region is halved into front and rear portions. The upper and lower portions of each of the occiput part of the head and the occiput region indicate the upper and lower portions obtained when each of the occiput part of the head and the occiput region is halved into upper and lower portions.

Figure 6:
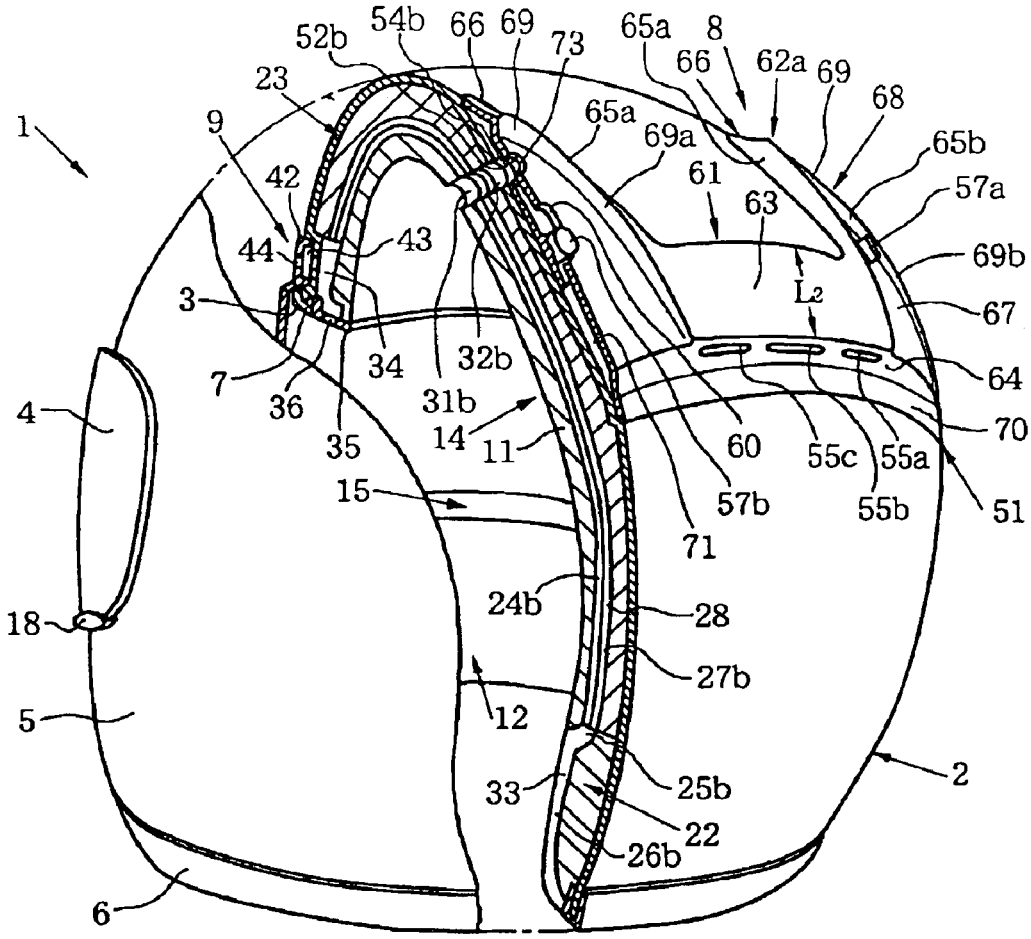
FIG. 6 is a partially cut-away perspective view, seen from obliquely behind the upper right, of the helmet of FIG. 1, in which various types of members attached to impact-on-the-head and impact-on-the-chin-and-cheek absorbing liners are omitted.
Figure 8:
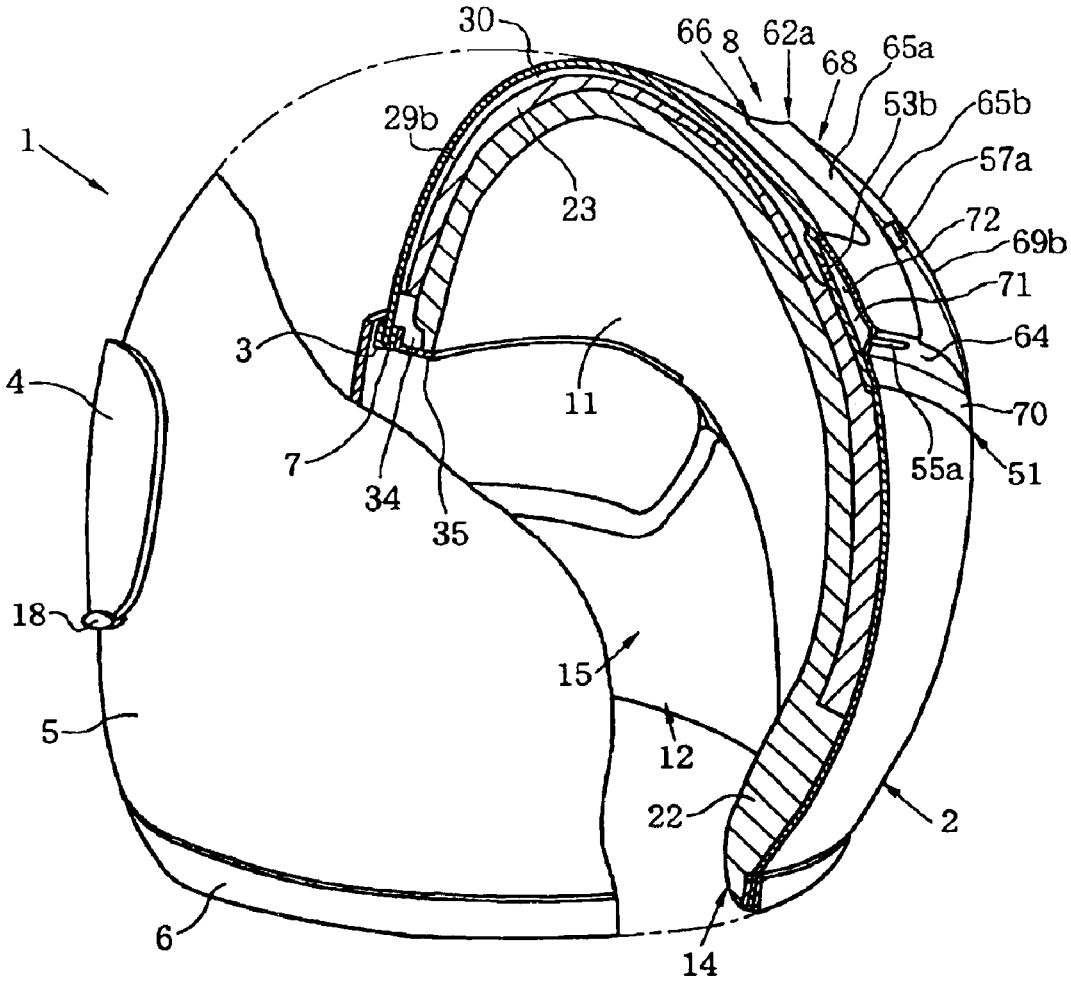
FIG. 8 is a perspective view, similar to FIG. 6, of the helmet of FIG. 1 which is partially cut away at a position different from that of FIG. 6.

Hence, as shown in FIGS. 6 and 8, the head protecting body 2 can be made up of a full-face-type outer shell 5 which constitutes the outer circumferential wall of the head protecting body 2, a lower rim member 6 having a substantially U-shaped cross-section and fixed to the outer shell 5 throughout the lower end of the outer shell 5 by adhesion or the like, a rim member 7 for a window opening, which has a substantially E-shaped cross-section and fixed to the outer shell 5 throughout the periphery of a window opening, formed in the outer shell 5 to form the window opening 3 of the head protecting body 2, by adhesion or the like, a cap-like backing member 14 for the head, which is fixed to the outer shell 5 by adhesion or the like in contact with the inner surface of the outer shell 5 in a sinciput region, a vertex region, left and right temple regions and an occiput region respectively corresponding to the sinciput part, vertex part, left and right temple parts and occiput part of the head of the wearer, and a substantially semicircular ring-like backing member 15 for the chin and cheek, which is fixed to the outer shell 5 by adhesion or the like in contact with the inner surface of the outer shell 5 in chin and cheek regions respectively corresponding to the chin and cheeks of the wearer. The outer shell 5 can be made of a composite material formed by lining the inner surface of a strong shell body made of FRP or any other hard synthetic resin with a flexible sheet such as an unwoven fabric. The lower rim member 6 can be made of foamed vinyl chloride, synthetic rubber, or any other soft synthetic resin. The rim member 7 for the window opening can be made of an elastic material with high flexibility such as synthetic rubber.

As has been known, the backing member 14 for the head shown in FIGS. 6 and 8 can be constituted by a cap-like impact-on-the-head absorbing liner 11 and a air-permeable backing cover for the head (not shown) attached to the impact-on-the-head absorbing liner 11 by adhesion, with a tape, or the like so as to cover almost the entire inner surface of the impact-on-the-head absorbing member 11 in the sinciput region, the vertex region and the occiput region excluding the left and right temple regions respectively corresponding to the left and right temple parts of the head of the wearer. As has been known, the backing member 15 for the chin and cheeks shown in FIGS. 6 and 8 can be constituted by a substantially semicircular ring-like impact-on-the-chin-and-cheek absorbing liner 12 and a pair of left and right blockish inside pads (not shown) attached to the impact-on-the-chin-and-cheek absorbing liner 12 by adhesion or the like in contact with the inner surface of the impact-on-the-chin-and-cheek absorbing liner 12 by adhesion or the like in left and right cheek regions corresponding to the left and right cheeks of the wearer.

As has been known, the shield plate 4 is pivotally attached to the head protecting body 2 with a pair of right and left attaching screws 16. The shield plate 4 closes the window opening 3 at the backward pivoting position shown in FIGS. 2 and 4 and opens the window opening 3 at the forward pivoting position where the shield plate 4 has pivoted upward from the backward pivoting position. At the intermediate position between these positions, the shield plate 4 can partly open the window opening 3. The shield plate 4 can be made of a transparent or translucent hard material such as polycarbonate or any other synthetic resin. In FIGS.

2 and 4, reference numeral 17 denotes a tap formed on the shield plate 4. The tap 17 is held by the wearer with his fingers when the wearer is to pivot upward or downward the shield plate 4 forward or backward. Reference numeral 18 denotes an operating lever formed on the head protecting body 2. The wearer operates the operating lever 18 when he is to operate the shield plate 4 to slightly pivot upward the shield plate 4, located at the backward pivoting position, forward.

(2) Impact-On-The-Head and Impact-On-The-Chin-And-Cheek Absorbing Liners

Figure 10:
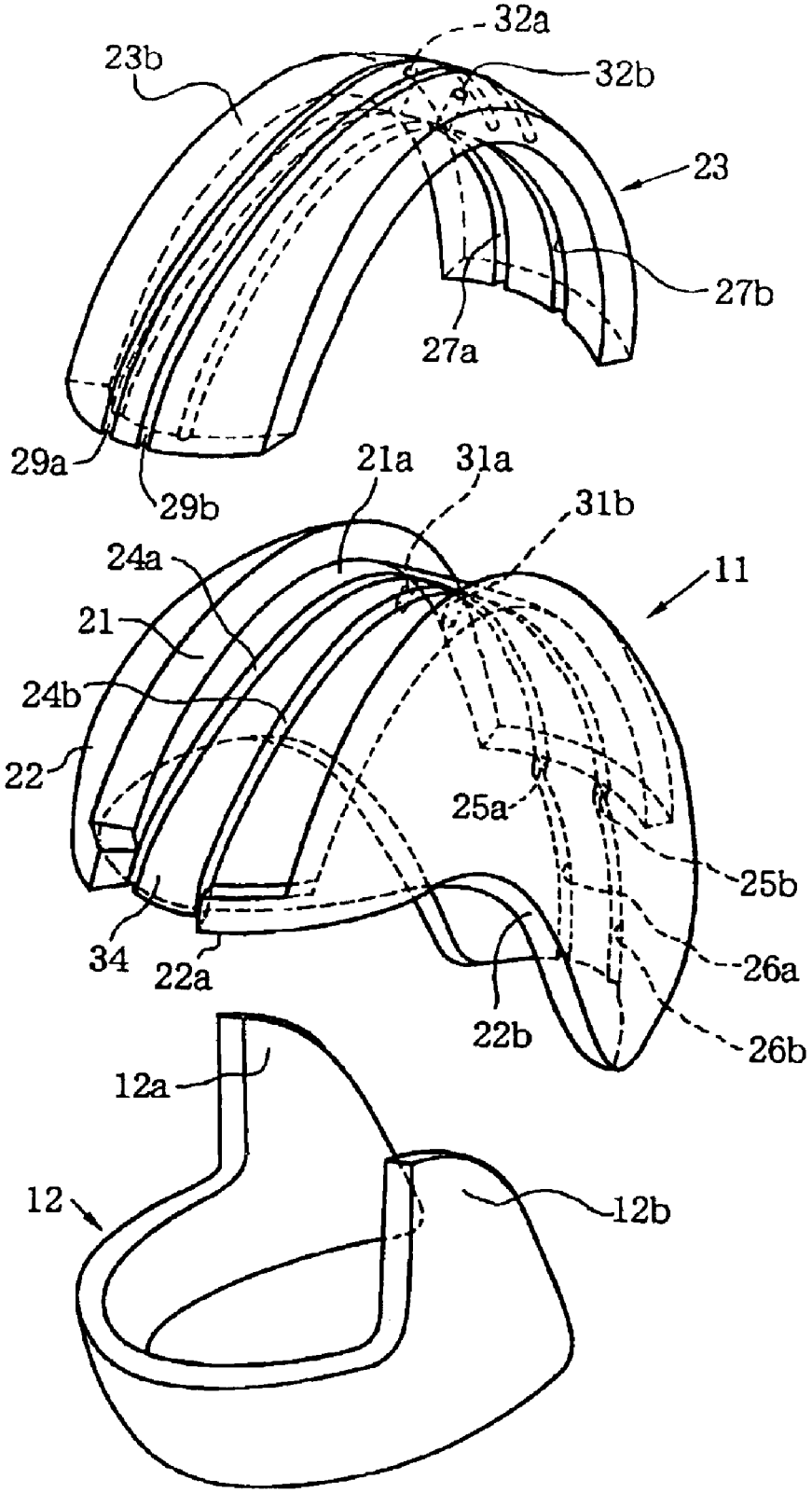
FIG. 10 is an exploded perspective view of the impact-on-the-head and impact-on-the-chin-and-cheek absorbing liners of the helmet shown in FIG. 1.

As shown in FIGS. 6, 8 and 10, the impact-on-the-head absorbing liner 11 is constituted by a conventionally known impact-on-the-head absorbing liner having a sinciput region, a vertex region, left and right side temple regions and an occiput region, which is formed of a main liner member 22 having an outer recess 21 in its outer surface and an outer auxiliary liner member 23 attached to the main liner member 22 to fit with the outer recess 21. The outer recess 21 extends from near a lower end 22*a* of the sinciput region of the main liner member 22 to the intermediate position of the occiput region or slightly above it through the sinciput region and vertex region, and has a substantially semicircular ring-like shape. A ventilation space 34, which is narrower than the outer recess 21 and through which the outer recess 21 communicates with the lower end 22*a*, is formed between the outer recess 21 and the lower end 22*a* of the sinciput region. The outer auxiliary liner member 23 has a substantially semicircular ring-like shape substantially identical with the outer recess 21. The outer auxiliary liner member 23 is fitted in the outer recess 21 with its inner surface 23*a* in contact with a bottom surface 21*a* of the outer recess 21 of the main liner member 22, so that it is attached to the main liner member 22. The contact surfaces of the inner surface 23*a* and bottom surface 21*a* can be adhered with an adhesive or the like when necessary.

Figure 7:
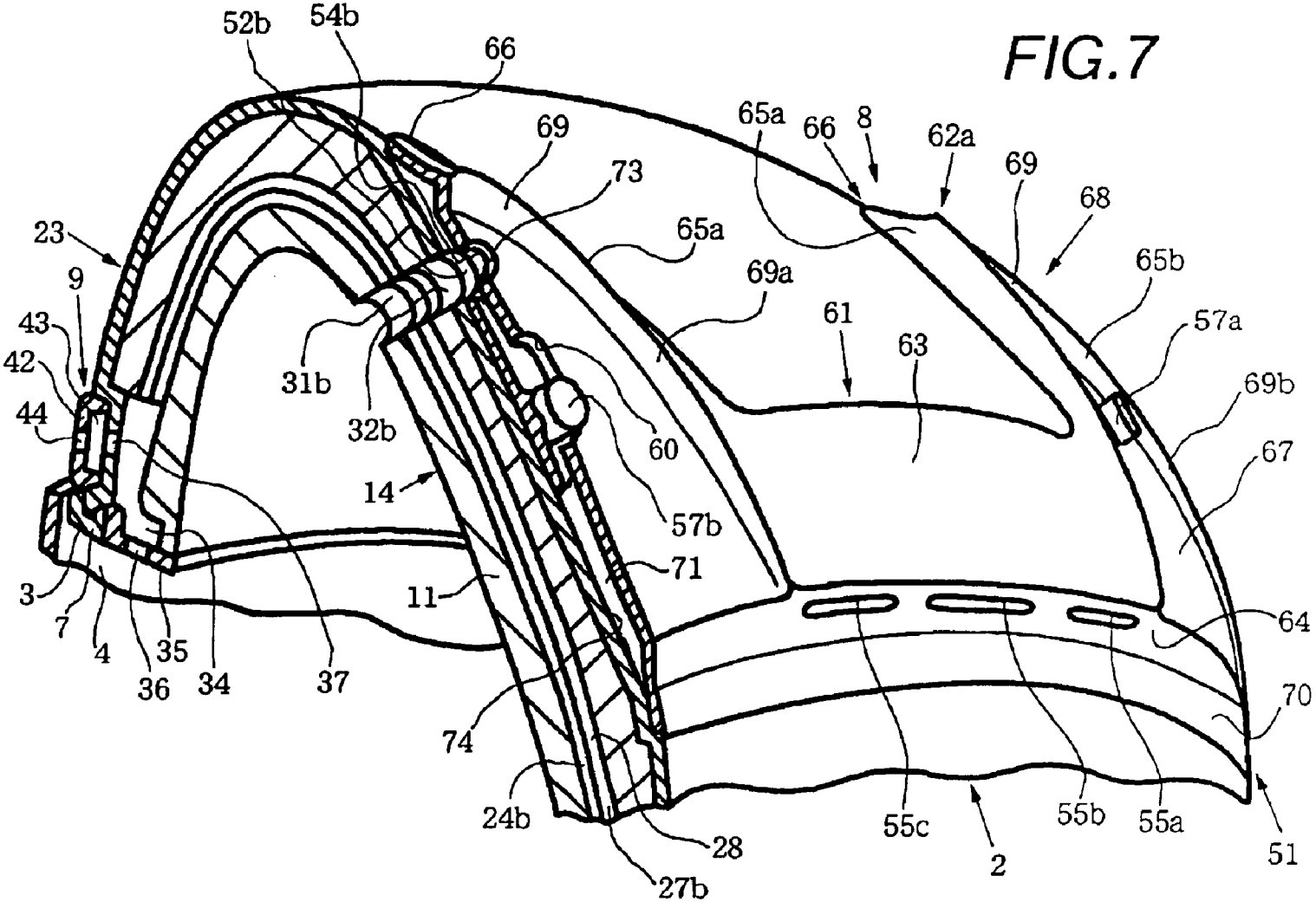
FIG. 7 is a partial enlarged view of FIG. 6.

As shown in FIGS. 6, 7 and 10, the bottom surface 21*a* of the outer recess 21 of the main liner member 22 has a pair of left and right outer ridge grooves (i.e., laesulas) 24*a* and 24*b* which extend from the lower end 22*a* of the sinciput region to the intermediate position of the occiput region or slightly above it through the sinciput region and the vertex region (in other words, from the front end to rear end of the outer recess 21 throughout substantially its entire length). The terminal ends (i.e., rear ends) of the outer ridge grooves 24*a* and 24*b* connect to a pair of left and right through holes 25*a* and 25*b* which extend through the main liner member 22 substantially in the direction of thickness. The inner surface of the occiput region of the main liner member 22 (i.e., a surface on the side of the head accommodating space which accommodates the head of the wearer) has a pair of left and right inner ridge grooves (i.e., laesulas) 26*a* and 26*b* extending from the through holes 25*a* and 25*b* to a lower end 22*b* of the occiput region. The start ends (i.e., upper ends) of the inner ridge grooves 26*a* and 26*b* connect to the through holes 25*a* and 25*b*.

As shown in FIGS. 6, 7 and 10, the inner surface 23*a* of the substantially semicircular ring-like outer auxiliary liner member 23 has a pair of left and right inner ridge grooves (i.e., laesulas) 27*a* and 27*b* so as to correspond to the pair of left and right outer ridge grooves 24*a* and 24*b* of the main liner member 22. The inner ridge grooves 27*a* and 27*b* are formed throughout substantially the entire length in the back-and-forth direction of the outer auxiliary liner member 23. When the outer auxiliary liner member 23 is attached to the main liner member 22 as described above, the inner ridge grooves 27*a* and 27*b* substantially overlap the outer ridge grooves 24*a* and 24*b* in the direction of thickness of the impact-on-the-head absorbing liner 11, as shown in FIGS. 6 and 7. Hence, these ridge grooves 24*a* and 24*b*, and 27*a* and 27*b* form a pair of left and right ventilation holes 28 inside the impact-on-the-head absorbing liner 11 (i.e., between the outer and inner surfaces). As shown in FIGS. 6 and 7, these ventilation holes 28 extend from a ventilation opening 34 to the through holes 25*a* and 25*b*.

As shown in FIGS. 6, 7 and 10, the vertex region of the main liner member 22 has, at the vicinity of its rear end, a pair of left and right through holes 31*a* and 31*b* which connect to the pair of left and right outer ridge grooves 24*a* and 24*b* and extend through the main liner member 22 substantially in the direction of thickness. The outer auxiliary liner member 23 has a pair of left and right through holes 32*a* and 32*b*, which extend through the outer auxiliary liner member 23 substantially in the direction of thickness, to respectively correspond to the pair of left and right through holes 31*a* and 31*b* of the main liner member 22. When the outer auxiliary liner member 23 is attached to the main liner member 22 as described above, the through holes 32*a* and 32*b* overlap the through holes 31*a* and 31*b* in the direction of thickness of the impact-on-the-head absorbing liner 11 and communicate with them, as shown in FIGS. 6 and 7. Hence, these through holes 31*a* and 31*b*, and 32*a* and 32*b* form the combinations of the pairs of left and right through holes 31*a* and 31*b*, and 32*a* and 32*b* which extend through the impact-on-the-head absorbing liner 11 in substantially the direction of thickness.

Figure 9:
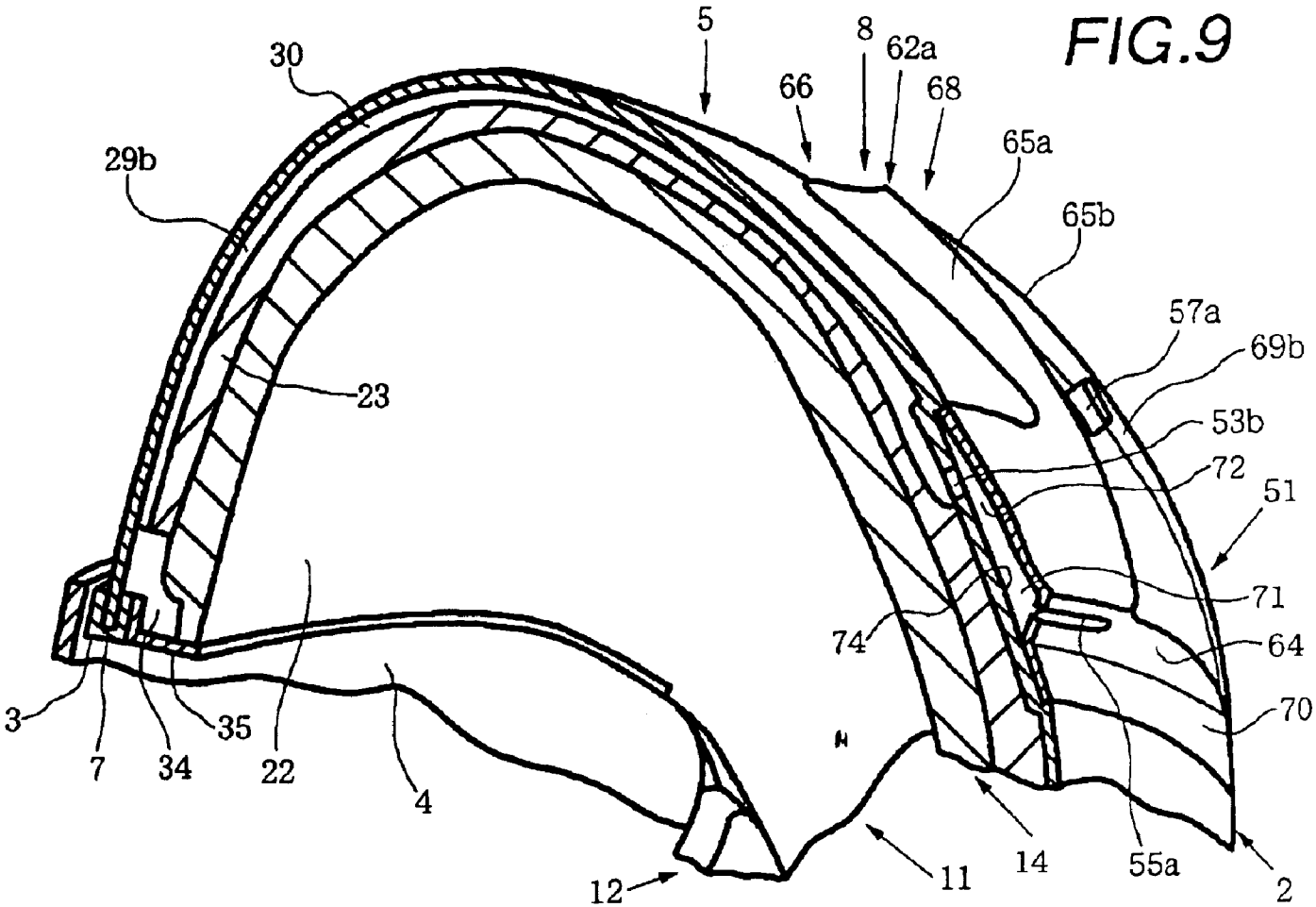
FIG. 9 is a partial enlarged view of FIG. 8.

An outer surface 23*b* of the outer auxiliary liner member 23 has a pair of left and right outer ridge grooves (i.e., laesulas) 29*a* and 29*b*. The outer ridge grooves 29*a* and 29*b* extend from near the front end to a portion slightly behind the intermediate portion (in other words, near the intermediate position of the occiput region of the impact-on-the-head absorbing liner 11 or slightly above it) of the outer auxiliary liner member 23. When the impact-on-the-head absorbing liner 11 is attached to the outer shell 5, the outer surface 23*b* of the outer auxiliary liner member 23 is in contact with the inner surface of the outer shell 5. Hence, the outer ridge grooves 29*a* and 29*b* and the inner surface of the outer shell 5 form a pair of left and right ventilation holes 30 in the outer surface of the impact-on-the-head absorbing liner 11, as shown in FIGS. 8 and 9. These ventilation holes 30 extend from the ventilation space 34 to a portion slightly behind the intermediate portion of the outer auxiliary liner member 23, as shown in FIGS. 8 and 9.

The pair of left and right ventilation holes 30 shown in FIG. 9 (in other words, the pair of left and right outer ridge grooves 29*a* and 29*b*) are located between a pair of left and right ventilation holes 28 shown in FIG. 8 (in other words, the pairs of the left and right ridge grooves 24*a* and 24*b*, and 27*a* and 27*b*) in the left-to-right direction, as shown in FIG. 10. Conversely to this, the pair of left and right ventilation holes 28 may be located between the pair of left and right ventilation holes 30 in the left-to-right direction. The pair of left and right ventilation holes 30 and the pair of left and right ventilation holes 28 can be arranged such that they are staggered in the left-to-right direction.

As described above, the inner surface of the impact-on-the-head absorbing liner 11 (in other words, the main liner member 22) is substantially covered by the backing cover for the head (not shown). Accordingly, the pair of left and right inner ridge grooves 26*a* and 26*b* formed in the inner surface of the main liner member 22, and the backing cover for the head form a pair of left and right ventilation holes 33, as shown in FIGS. 6 and 10. These ventilation holes 33 extend from the through holes 25*a* and 25*b* to the lower end of the impact-on-the-head absorbing liner 11, as shown in FIG. 6. As the backing cover for the head is air-permiable, these ventilation holes 33 are breathing with respect to the head accommodating space that accommodates the head of the wearer.

Of the substantially semicircular ring-like impact-on-the-chin-and-cheek absorbing liner 12, its left and right ends in the horizontal direction are projected upward, so that a pair of left and right projections 12*a* and 12*b* are formed integrally with the liner 12. When the impact-on-the-head absorbing liner 11 and impact-on-the-chin-and-cheek absorbing liner 12 are attached to the inner surface of the outer shell 5 in contact with it, the projections 12*a* and 12*b* abut against the lower surfaces of the left and right temple head regions of the impact-on-the-head absorbing liner 11.

Each of the main liner member 22 and outer auxiliary liner member 23 of the impact-on-the-head absorbing liner 11 and of the impact-on-the-chin-and-cheek absorbing liner 12 can be made of a material with appropriate rigidity and plasticity such as polystyrene foam or any other synthetic resin.

(3) Forehead and Chin Ventilator Mechanisms

Figure 2:
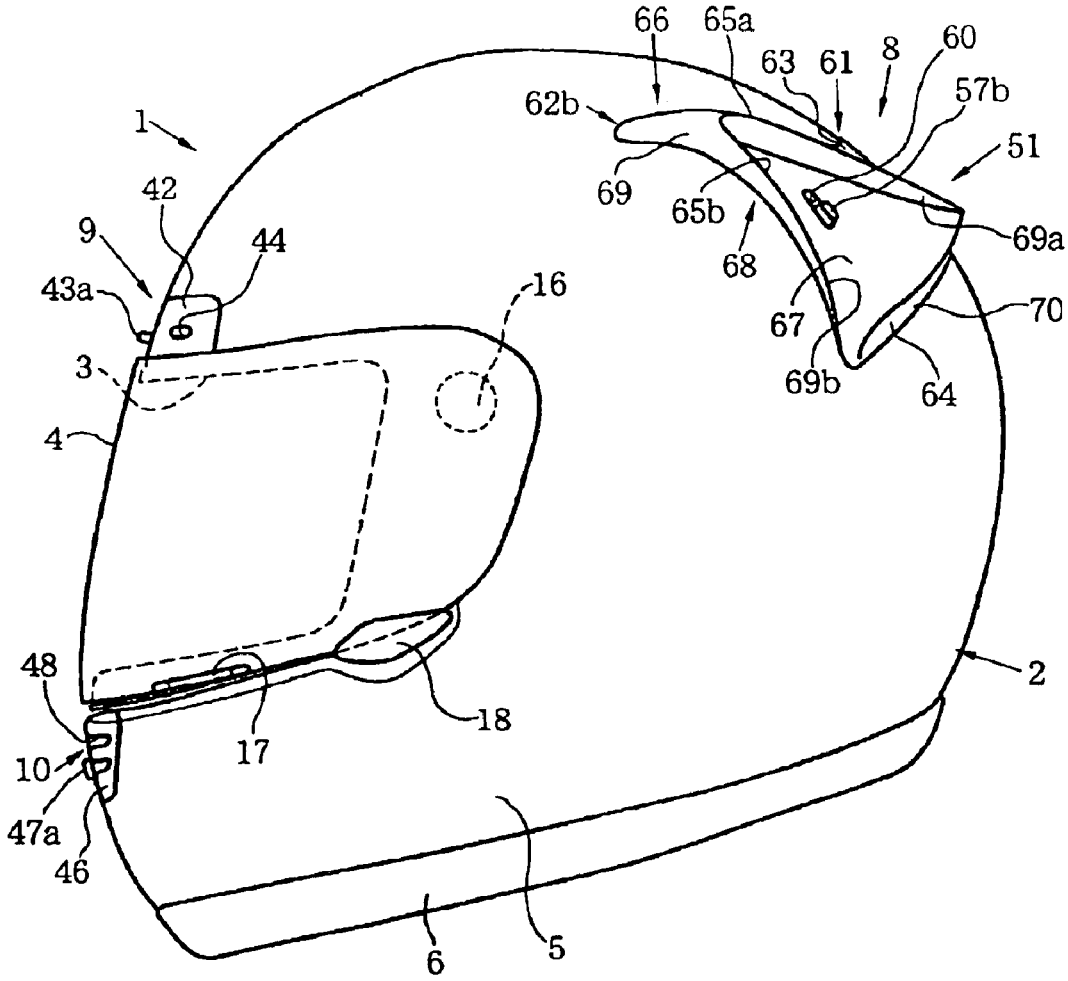
FIG. 2 is a right side view of the helmet of FIG. 1.
Figure 3:
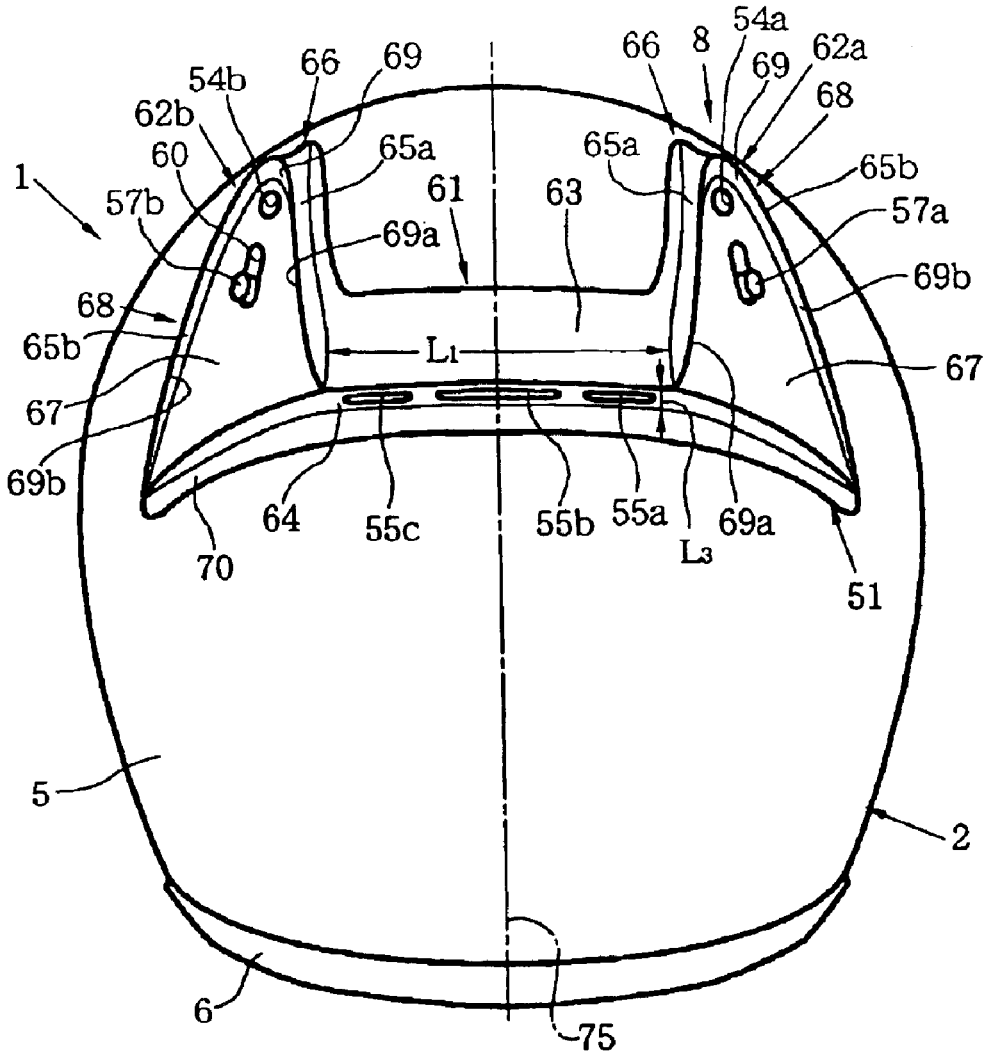
FIG. 3 is a rear view of the helmet of FIG. 1.
Figure 4:
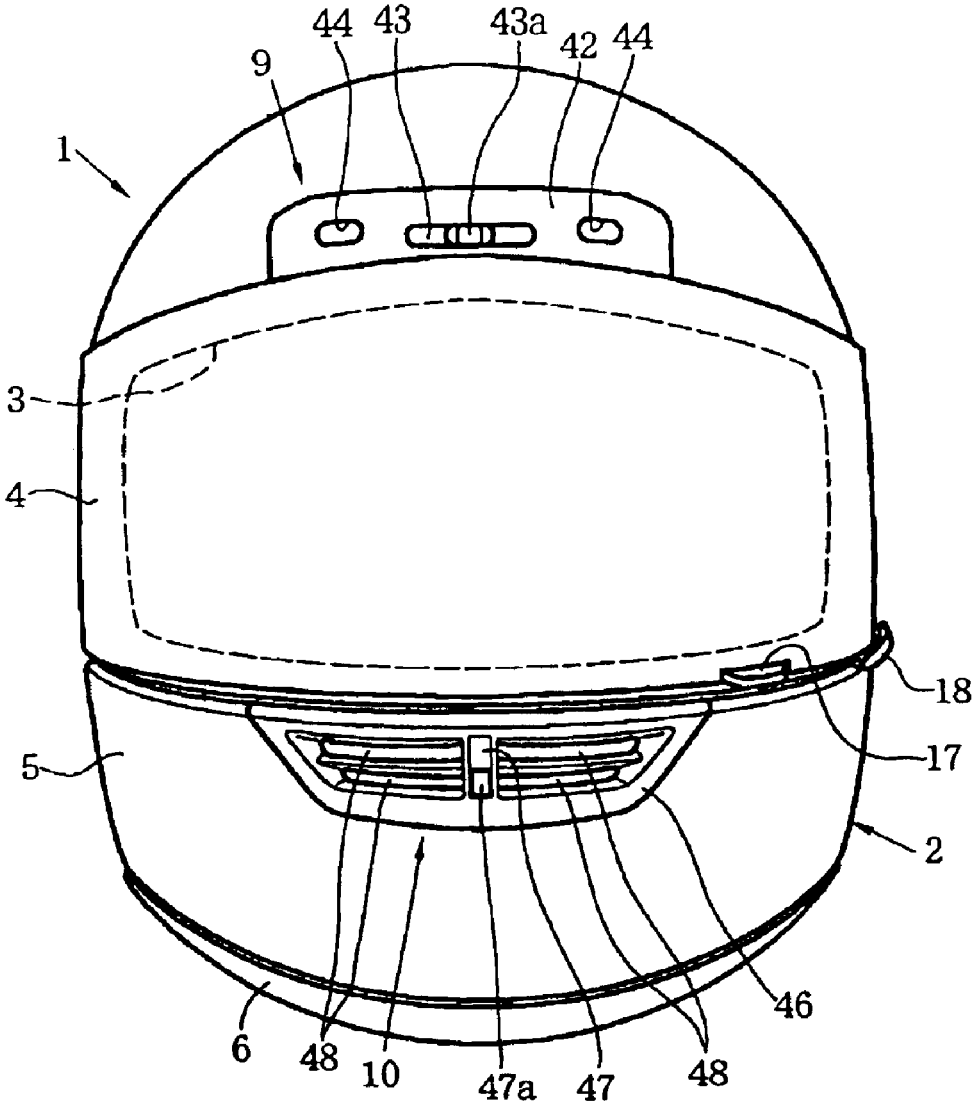
FIG. 4 is a front view of the helmet of FIG. 1.

The forehead ventilator mechanism 9 shown in FIGS. 2, 4 and 6 can be basically constituted by a ventilation opening forming member 42 attached to the forehead region on the outer surface of the outer shell 5 by adhesion or the like, and a shutter member 43 attached to the ventilation opening forming member 42 or outer shell 5 in order to open and close ventilation openings 44 formed in the ventilation opening forming member 42, or a ventilation opening 37 formed in the outer shell 5. When an operating tap 43*a* formed on the shutter member 43 is operated forward and backward, the shielding plate of the shutter member 43 opens and closes the ventilation openings 44 or ventilation opening 37.

The chin ventilator mechanism 10 shown in FIGS. 2 and 4 can be basically constituted by a ventilation opening forming member 46 attached to the chin region on the outer surface of the outer shell 5 by adhesion or the like, and a shutter member 47 attached to the ventilation opening forming member 46 or outer shell 5 in order to open and close ventilation openings 48 formed in the ventilation opening forming member 46, or a ventilation opening (not shown) formed in the outer shell 5. When an operating tap 47*a* formed on the shutter member 47 is operated forward and backward, the shielding plate of the shutter member 47 opens or closes the ventilation openings 48 or the ventilation opening of the outer shell 5.

Hence, while the ventilation openings 44 of the forehead ventilator mechanism 9 and the ventilation openings 48 of the chin ventilator mechanism 10 respectively are open, when the wearer puts on the full-face-type helmet 1 and drives on a motor cycle, the forehead ventilator mechanism 9 and chin ventilator mechanism 10 function in the following manner.

More specifically, the outer air relatively flowing from the ventilation openings (i.e., intake openings) 48 of the chin ventilator mechanism 10 to the inside of the ventilation opening forming member 46 flows relatively into a ventilation space (not shown), formed between the outer shell 5 and impact-on-the-chin-and-cheek absorbing liner 12, through the ventilation opening (i.e., intake opening) formed in the outer shell 5. The outer air then rises from the ventilation space to near the lower end of the inner surface of the shield plate 4. At least part of the outer air that has risen further rises from near the lower end to near the upper end of the inner surface of the shield plate 4 along the inner surface of the shield plate 4. Therefore, the outer air effectively prevents the shield plate 4 from being fogged by the breath exhaled by the wearer.

At least part of the outer air that has risen near the upper end of the inner surface of the shield plate 4 flows into the ventilation space 34 through a ventilation opening 36 formed in a locking member 35 attached to the lower end portion of the sinciput region (i.e., the lower end portion of the forehead region) of the main liner member 22, as shown in FIGS. 6 to 9. As has been known, the locking member 35 is used for attaching a backing cover for the head (not shown) to the impact-on-the-head absorbing liner 11.

The outer air that has relatively flown from the ventilation openings (i.e., intake openings) 44 of the forehead ventilator mechanism 9 to the inside of the ventilation opening forming member 42 relatively flows into the ventilation space 34 through the ventilation opening (i.e., intake opening) 37 formed in the outer shell 5. Part of each of the two types of outer air that has flown from the ventilation openings 36 and 37 into the ventilation space 34 flows into the ventilation holes 28 and shifts backward in the impact-on-the-head absorbing liner 11, while another part flows into the ventilation holes 30 and shifts backward along the outer surface of the impact-on-the-head absorbing liner 11 (in other words, the outer auxiliary liner member 23).

In place of the forehead ventilator mechanism 9, or in addition to the forehead ventilator mechanism 9 as shown in the second embodiment (to be described later), a front head side ventilator mechanism (not shown) having an arrangement identical to that of the forehead ventilator mechanism 9 can be formed at at least part of the upper portion of the sinciput region and the front portion of the vertex region on the outer surface of the outer shell 5 and their vicinities. In this specification, the upper portion of each of the sinciput part of the head and the sinciput region indicates the upper portion which is obtained when each of the sinciput part of the head and the sinciput region is halved.

Each of the ventilation opening forming members 42 and 46 and of the shutter members 43 and 47 can be made of a material with appropriate elasticity and rigidity such as polycarbonate, polyacetal, ABS, nylon, or any other synthetic resin.

(4) Back Head Side Ventilator Mechanism

The back head side ventilator mechanism 8 shown in FIGS. 1 to 3 and FIGS. 5 to 9 can be basically constituted by a ventilation opening forming member 51 serving also as a stabilizer constituting member, and a pair of left and right shutter mechanisms 56 attached to the outer shell 5 or ventilation opening forming member 51. The pair of left and right shutter mechanisms 56 are formed to open and close a pair of left and right ventilation openings 52*a* and 52*b* and a pair of left and right ventilation openings 53*a* and 53*b* formed in the outer shell 5, or open and close a pair of left and right ventilation openings 54*a* and 54*b* formed in the ventilation opening forming member 51, and a series of ventilation openings 55*a*, 55*b* and 55*c* extending in the left-to-right direction. The shutter mechanisms 56 have a pair of left and right operating taps 57*a* and 57*b*. When the operating taps 57*a* and 57*b* are operated forward and backward, the shielding plates (to be described later) of the shutter mechanisms 56 open and close the ventilation openings 52*a* and 53*a*, and 52*b* and 53*b*, or open and close the ventilation openings 54*a* and 54*b*, and 55*a* to 55*c*.

The practical structures of the ventilation opening forming member 51 and shutter mechanisms 56 will be described with reference to FIG. 1 and FIGS. 5 to 9.

As shown in FIGS. 6 to 9, the ventilation opening forming member 51 can be attached to the outer surface of the outer shell 5 at at least part of the vertex region (i.e., its front and rear portions) and the upper portion of the occiput region of the outer shell 5, and their vicinities. In the embodiment shown in FIGS. 6 to 9, the ventilation opening forming member 51 is attached at substantially the central position in the left-to-right direction. The ventilation opening forming member 51 serves also as the stabilizer constituting member. As shown in FIGS. 1 and 3 and FIGS. 5 to 7, the ventilation opening forming member 51 has a stabilizer portion 61 serving also as a ventilation opening forming portion at substantially its central portion in the left-to-right direction, and a left air current divider portion 62*a* and right air current divider portion 62*b* which are adjacent to the left and right sides of the stabilizer portion 61. Hence, the stabilizer portion 61 serving also as the ventilation opening forming portion and the pair of left and right air current divider portions 62*a* and 62*b* are formed in common at the integrally molded single ventilation opening forming member 51.

Figure 5:
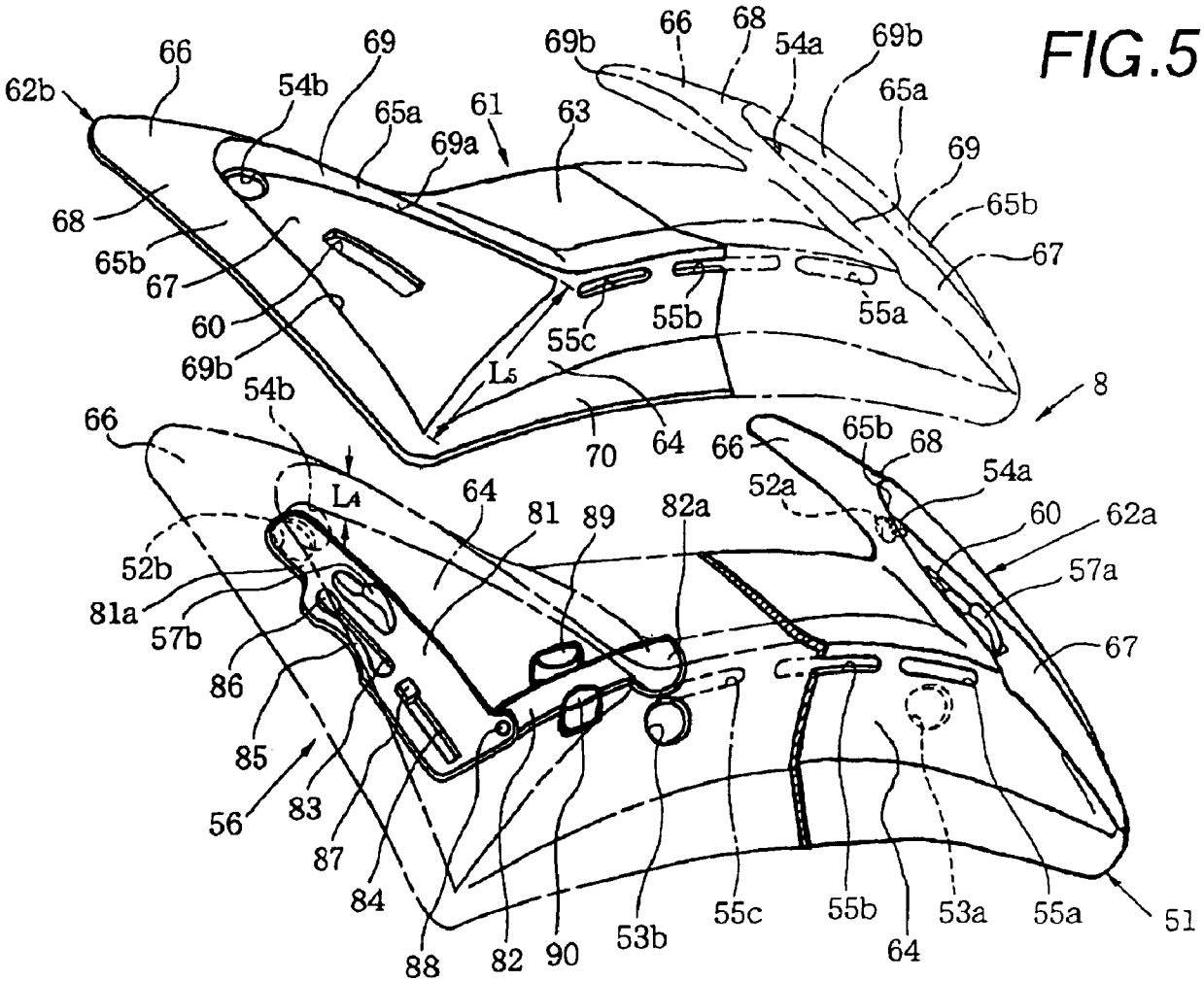
FIG. 5 is a perspective view, seen from obliquely behind the upper right, of a back head side ventilator mechanism of the helmet of FIG. 1, in which a ventilation opening forming member, serving also as a stabilizer constituting member, of the back head side ventilator mechanism is halved and one half is separated.

As shown in FIG. 5, the stabilizer 61 has an air current deflection portion or air current deflection surface 63 extending backward from near the boundary of the vertex region and occiput region of the outer surface of the outer shell 5, and a step portion or step surface 64 formed by bending the air current deflection surface 63 at its lower end (i.e., rear end) substantially toward the outer surface of the outer shell 5. The outer surface of the air current deflection surface 63 at the front end is substantially flush with the outer surface of the outer shell 5. In order to form this arrangement easily, a recess 74 may be formed in that outer side surface of the outer shell 5 which corresponds to the ventilation opening forming member 51, as shown in FIGS. 7 and 9. The air current deflection surface 63 gradually separates from the outer surface of the outer shell 5 in the range of the front end to the rear end, and is the farthest at its rear end from the outer side surface of the outer shell 5. The step surface 64 extends from the rear end of the air current deflection surface 63 substantially toward the outer surface of the outer shell 5 till near its outer surface, and extends long substantially like a band in the left-to-right direction. One or a plurality of ventilation openings 55*a*, 55*b* and 55*c* are formed in the step surface 64. In the embodiment shown in FIG. 1 and FIGS. 5 to 9, the number of ventilation openings is three. The three ventilation openings 55*a*, 55*b* and 55*c* extending horizontally in the left-to-right direction are formed in a row in the left-to-right direction.

An average angle formed by the air current deflection surface 63 and step surface 64 is about 75° in the embodiment shown in FIG. 1 and FIGS. 5 to 9, but generally preferably falls within a range of 45° to 120° from the viewpoint of practicality, and more preferably a range of 60° to 100°. The air current deflection surface 63 can be substantially rectangular, and its average length $L_1$ (see FIG. 3) in the left-to-right direction (a length between the left and right ends actually along the air current deflection surface 63) is about 120 mm in the embodiment shown in FIG. 3, but generally preferably falls within a range of 60 mm to 240 mm from the viewpoint of practicality, and more preferably a range of 80 mm to 180 mm. An average length $L_2$ (see FIG. 6) in the back-and-forth direction (a length between the front and rear ends actually along the air current deflection surface 63) of the air current deflection surface 63 is about 60 mm in the embodiment shown in FIG. 6, but generally preferably falls within a range of 30 mm to 120 mm from the viewpoint of practicality, and more preferably a range of 40 mm to 90 mm. An average length (i.e., width) $L_3$ (see FIG. 3) of the step surface 64 (but at its portion which opposes the air current deflection surface 63 in the back-and-forth direction) in a direction substantially perpendicular to the left-to-right direction is about 10 mm in the embodiment shown in FIG. 3, but generally preferably falls within a range of 4 mm to 26 mm from the viewpoint of practicality, and more preferably a range of 6 mm to 18 mm.

The pair of left and right air current divider portions 62*a* and 62*b* can be axi-symmetric to each other with respect to a center line (actually a center plane) 75 (see FIG. 3) of the full-face-type helmet 1 which extends in the back-and-forth direction. Hence, in the following description, the right air current divider portion 62*b* will be described in detail, and a detailed description on the left air current divider portion 62*a* will be omitted.

As shown in FIG. 5, the air current divider portion 62*b* has a pair of left and right projecting ridges 65*a* and 65*b* extending substantially in the back-and-forth direction. The projecting ridges 65*a* and 65*b* are continuous to each other at their front ends, and their rear ends extend to gradually open apart substantially backward, to form a substantially V-shaped or two-way forked projecting portion 66 as a whole. In the specification, that projecting ridge which is located nearer the center line 75 is denoted by reference numeral 65*a*, and that projecting ridge which is located on the opposite side of the center line 75 (i.e., on the outer side in the left-to-right direction) is denoted by reference numeral 65*b*.

The air current divider portion 62*b* has a substantially acute triangular bottom surface 67 formed of a region surrounded by the V-shaped or two-way forked projecting ridge 66, as shown in FIG. 5. The ventilation opening 54*b* (54*a* in the case of the left air current divider portion 62*a*) is formed near the front end of the bottom surface 67, and an operating tap slit 60 is formed at substantially the central portion of the bottom surface 67. Although only one ventilation opening 54*b* is formed in each bottom surface 67 in the embodiment shown in FIG. 5, a plurality of ventilation openings 54*b* may be formed. Hence, the ventilation opening 54*b* is surrounded by that portion of the V-shaped projecting ridge 66 which is near its front end. The V-shaped projecting ridge 66 and the bottom surface 67 are continuous to each other through a substantially V-shaped or two-way forked step portion or step surface 69. An outer peripheral portion (i.e., a V-shaped peripheral portion) 68 of the V-shaped projecting ridge 66 which is on the opposite side to the V-shaped step surface 69 gradually separates from the outer surface of the outer shell 5 in the range of the outer surface of the outer shell 5 to the V-shaped step surface 69, and is the farthest at its portion which is adjacent to the V-shaped step surface 69.

One half (i.e., one step surface portion) 69*a* of the V-shaped or two-way forked step surface 69 which is adjacent to the projecting ridge 65*a* at the center side in the left-to-right direction can be inclined from the outer side to the inner side at an appropriate angle with respect to the center line 75 in the range of the front end to the rear end. An average angle of inclination is about 15° in the embodiment shown in FIG. 5, but generally preferably falls within a range of −10° to 40° from the viewpoint of practicality, and more preferably a range of 5° to 25°. The other half (i.e., the other step surface portion) 69*b* of the V-shaped or two-way forked step surface 69 which is adjacent to the outer projecting ridge 65*b* in the left-to-right direction can be inclined from the inner side to the outer side at an appropriate angle with respect to the center line 75 in the range of the front end to the rear end. An average angle of inclination is about 20° in the embodiment shown in FIG. 5, but generally preferably falls within a range of −5° to 45° from the viewpoint of practicality, and more preferably a range of 10° to 30°. Hence, an average angle formed by the pair of step surface portions 69*a* and 69*b* of the V-shaped or two-way forked step surface 69 is about 35° in the embodiment shown in FIG. 5, but generally preferably falls within a range of 15° to 60° from the viewpoint of practicality, and more preferably a range of 20° to 50°.

A linear length (i.e., linear width) $L_4$ (see FIG. 5) of the V-shaped or two-way forked step surface 69 from the bottom surface 67 to the V-shaped projecting ridge 66 is about 6.5 mm around the ventilation opening 54*b* (54*a* in the case of the left air current divider portion 62*a*) in the embodiment shown in FIG. 5, but generally preferably falls within a range of 2.5 mm to 16 mm from the viewpoint of practicality, and more preferably a range of 4.5 mm to 12 mm.

The portion between that end (i.e., the proximal end) of the V-shaped step surface 69 which is near the bottom surface 67 and that end (i.e., the distal end) which is near the V-shaped projecting ridge 66 need not be linear, but may form, e.g., a recessed surface toward the V-shaped projecting ridge 66. The width $L_4$ of the V-shaped step surface 69 can gradually decrease from the front ends to the rear ends of the projecting ridges 65*a* and 65*b*, and can be equal to ¼ or less the maximum value of the above width, or substantially zero at the rear ends of the projecting ridges 65*a* and 65*b*.

The lengths (lengths actually along the step surface 69) of one half 69*a* and the other half 69*b* of the V-shaped or two-way forked step surface 69 are respectively about 80 mm and about 90 mm in the embodiment shown in FIG. 5, but generally preferably fall within a range of 30 mm to 200 mm from the viewpoint of practicality, and more preferably a range of 40 mm to 160 mm. A distance (a length actually along the bottom surface 67) $L_5$ (see FIG. 5) between the rear end of one half 69*a* and the rear end of the other half 69*b* of the V-shaped step surface 69 is about 60 mm in the embodiment shown in FIG. 5, but generally preferably falls within a range of 30 mm to 120 mm from the viewpoint of practicality, and more preferably a range of 40 mm to 90 mm. An average angle of inclination (particularly an average angle around the ventilation opening 54*b*) formed by the V-shaped step surface 69 with respect to the outer surface (that portion opposing the v-shaped projecting ridge 66) of the outer shell 5 is about 60° in the embodiment shown in FIG. 5, but generally preferably falls within a range of 35° to 120° from the viewpoint of practicality, and more preferably a range of 45° to 100°.

The rear ends of the bottom surfaces 67 of the air current divider portions 62*a* and 62*b* continue to the step surface 64 of the stabilizer portion 61. The width of the step surface 64 gradually decreases at the continuous portion toward the two outer sides in the left-to-right direction. A connecting portion 70 extending like a band in the left-to-right direction substantially along the outer surface of the outer shell 5 is integrally formed at the rear end of the step surface 64. Hence, in the ventilation opening forming member 51, the stabilizer portion 61, pair of left and right air current divider portions 62*a* and 62*b* and connected portion 70 are molded integrally.

The pair of left and right shutter mechanisms 56 can be axi-symmetric to each other with respect to the center line 75 as the axis of symmetry. Accordingly, in the following description, the right shutter mechanism 56 will be described in detail, and a detailed description on the left shutter mechanism 56 will be omitted.

The right shutter mechanism 56 has a main shutter member 81 serving also as an operating member, and an auxiliary shutter member 82. The right shutter mechanisms 56, except for the operating tap 57*b* (57*a* in the case of the left shutter mechanism 56) formed on the main shutter member 81, is covered with the ventilation opening forming member 51, the inner periphery of which is attached to the outer surface of the outer shell 5 by adhesion with an adhesive or the like. Therefore, the ventilation opening forming member 51 also serves as a cover member for the pair of left and right shutter mechanisms 56.

As shown in FIGS. 8 and 9, a ventilation space 71 is formed between the ventilation opening forming member 51 and outer shell 5. The pair of left and right ventilation openings 53*a* and 53*b* formed in the outer shell 5 are continuous to the terminal ends (i.e., rear ends) of the pair of left and right ventilation holes 30 formed between the outer surface 23*b* of the outer auxiliary liner member 23 (in other words, the impact-on-the-head absorbing liner 11) and the inner surface of the outer shell 5. Therefore, a first exhaust path 72 constituted by the ventilation openings 53*a* and 53*b*→ventilation space 71→ventilation openings 55*a*, 55*b* and 55*c* is formed in the head protecting body 2.

As shown in FIGS. 6 and 7, the pair of left and right ventilation openings 52*a* and 52*b* formed in the outer shell 5 are respectively continuous to the pair of left and right through holes 32*a* and 32*b* formed in the outer auxiliary liner member 23 (in other words, the impact-on-the-head absorbing liner 11). The pair of left and right ventilation openings 54*a* and 54*b* formed in the ventilation opening forming member 51 are respectively continuous to the pair of left and right ventilation openings 52*a* and 52*b* and the pair of left and right through holes 32*a* and 32*b*. Therefore, a pair of left and right second exhaust paths 73 constituted by the pair of left and right ventilation openings 52*a* and 52*b*→ventilation space 71→pair of left and right ventilation openings 54*a* and 54*b* are formed in the head protecting body 2. The pair of left and right ventilation openings 54*a* and 54*b* can set to oppose the pair of left and right ventilation openings 52*a* and 52*b* while they are away from them by a distance substantially corresponding to the thickness of the main shutter member 81.

As shown in FIG. 5, the main shutter member 81 can be a longitudinal plate body extending substantially along the longitudinal direction of the outer projecting ridge 65*b* of the V-shaped projecting ridge 66. The main shutter member 81 has a pair of front and rear guide slits 83 and 84 extending substantially along its longitudinal direction. One side edge of the front slit 83 forms an elastic deformable portion 85 which is curved in the lateral direction toward the front slit 83. Hence, the front slit 83 has a function of holding a guide projection 86 (to be described later) in position. The main shutter member 81 also integrally has the operating tap 57*b* (57*a* in the case of the left shutter mechanism 56) which can be operated forward and backward substantially along its longitudinal direction.

The outer shell 5 has the upper guide projection 86 and a lower guide projection 87, which form a pair and oppose the pair of upper and lower slits 83 and 84. The projections 86 and 87 are inserted in the guide slits 83 and 84 to be slidable relative to them. Near one end of the main shutter member 81, the auxiliary shutter member 82 is pivotally, axially supported, at its portion near its one end, by a shaft 88. The auxiliary shutter member 82 can be a longitudinal plate body extending substantially perpendicularly to the center line 75.

The outer shell 5 has a pair of front and rear support rods 89 and 90 for supporting the auxiliary shutter member 82, such that they oppose the intermediate portion of the auxiliary shutter member 82. The support rods 89 and 90 oppose each other at a distance substantially corresponding to the width of the intermediate portion of the auxiliary shutter member 82. The opposing surfaces of the support rods 89 and 90 form substantially semicircular cylindrical convex surfaces. The guide projections 86 and 87 and the support rods 89 and 90 need not be directly formed on the outer shell 5. All or some of the guide projections 86 and 87 and support rods 89 and 90 may be formed on a common auxiliary plate, and after that the auxiliary plate may be attached to the outer surface of the outer shell 5 by adhesion with, e.g., an adhesive.

A shielding plate 81*a* is formed at the free end of the main shutter member 81 to correspond to the ventilation opening 52*b* of the outer shell 5. Another shielding plate portion 82*a* is formed at the free end of the auxiliary shutter member 82 to correspond to the ventilation opening 53*b* of the outer shell 5.

Therefore, as shown in FIG. 5, while the ventilation openings 52*b* and 53*b* of the outer shell 5 is open, when the operating tap 57*b* (57*a* in the case of the left shutter mechanism 56) exposed to the outside through the operating tap slit 60 of the ventilation opening forming member 51 is operated forward, the main shutter member 81 moves forward toward the front side due to the guide function for the linear reciprocal motion of the guide slits 83 and 84 and guide projections 86 and 87. Hence, the shielding plate portion 81*a* of the main shutter member 81 closes the ventilation opening 52*b* (52*a* in the case of the left shutter mechanism 56) of the outer shell 5 from the outer surface. In this case, the shielding plate portion 81*a* may simultaneously close the ventilation opening 54*b* (54*a* in the case of the left shutter mechanism 56) of the ventilation opening forming member 51. Thus, the ventilation opening 52*b* changes from the open state to the closed state. When the main shutter member 81 is moved forward, the auxiliary shutter member 82 pivots forward clockwise in FIG. 5 about its intermediate portion as a fulcrum. Accordingly, the shielding plate portion 82*a* of the auxiliary shutter member 82 closes the ventilation opening 53*b* (53*a* in the case of the left shutter mechanism 56) of the outer shell 5 from the outer surface. Thus, the ventilation opening 53*b* changes from the open state to the closed state.

As described above, the ventilation openings 52*b* and 53*b* are closed or opened simultaneously upon the forward/backward operation of the single operating tap 57*b*. The right half of each of the first and second exhaust paths 72 and 73 can be closed or opened simultaneously. Upon the forward/backward operation, the guide projection 86 moves relatively to and fro in the guide slit 83 while temporarily elastically deforming the elastic deformable portion 85. Hence, the guide projection 86 will not accidentally move in the guide slit 83 relatively to and fro. Whether the operating tap 57*b* is operated forward or backward, the operating tap slit 60 is closed by the main shutter member 81.

In place of the elastic deformable portion 85, or in addition to the elastic deformable portion 85, a groove extending substantially along the direction of the reciprocal motion of the main shutter member 81 may be formed in the guide projection 86, so that elasticity can be imparted to the guide projection 86 itself. Each constituent member of the ventilation opening forming member 51 and shutter mechanisms 56 can be made of a material with appropriate elasticity and rigidity such as polycarbonate, polyacetal, ABS, nylon, or any other synthetic resin.

While the ventilation openings 52*a*, 52*b*, 53*a* and 53*b* of the back head side ventilator mechanism 8 having the above arrangement are open, when the wearer puts on the full-face-type helmet 1 and drives on a motor cycle, the back head side ventilator mechanism 8 operates in the following manner.

The traveling wind (i.e., outer air) flowing substantially along the outer surface of the outer shell 5 is relatively directed toward the occiput region through the vertex region. Thus, the traveling wind is forcibly separated from the outer surface of the outer shell 5 by the air current deflection surface 63 of the stabilizer portion 61, and shifts relatively backward while it maintains a substantially laminar state. As the amount of traveling wind abruptly detouring to the lower portion of the occiput region of the outer shell 5 is small, the drag (backward force) and lift (floating force) with respect to the head protecting body 2 can be decreased. As a negative pressure is generated near the step surface 64 of the stabilizer portion 61, air in the ventilation space 71 is forcibly discharged to the outside from the ventilation openings 55*a*, 55*b* and 55*c* serving as exhaust openings.

As the traveling wind is also directed relatively toward the V-shaped projecting ridges 66 of the air current divider portions 62*a* and 62*b*, it shifts relatively backward while it is divided into the left and right by the respective V-shaped projecting ridges 66. Hence, a negative pressure is generated near the V-shaped step surfaces 69 and bottom surfaces 67 of the air current divider portions 62*a* and 62*b*, and accordingly air in the ventilation space 71 is forcibly discharged to the outside from the ventilation openings 54*a* and 54*b* serving as exhaust openings. The substantially V-shaped projecting ridge 66 extending substantially in the back-and-forth direction and the substantially V-shaped step surface 69 extending substantially in the back-and-forth direction are axi-symmetrical. Thus, the pair of left and right air current divider portions 62*a* and 62*b* can prevent to a certain degree the wobbling of the head protecting body 2 in the left-to-right direction caused by the traveling wind. Also, the drag and lift can be decreased, if a little, because of substantially the same reason as in the case of the stabilizer portion 61.

As described in item (3) (item of "Forehead and Chin Ventilator Mechanisms"), air that has flown into the pair of left and right ventilation holes 28 and shifted to the pair of left and right through holes 32*a* and 32*b* of the outer auxiliary liner member 23 mixes with air that has shifted from the head accommodating space of the head protecting body 2 to the through holes 32*a* and 32*b* through the pair of left and right through holes 31*a* and 31*b* of the main liner member 22, as is apparent from FIGS. 6 and 7. Part of the air mixture is discharged well to the outside, which is set at the negative pressure as described above, from the ventilation openings 54*a* and 54*b* through the pair of left and right second exhaust paths 73 described above. Another part of the air mixture shifts further downward through the pair of left and right ventilation holes 28 and is discharged to the outside from the lower end portion of the occiput region of the head protecting body 2 through the pair of left and right through holes 25*a* and 25*b* and the pair of left and right ventilation holes 33, as is apparent from FIGS. 6 and 7.

As is described in item (3), air that has flown into the pair of left and right ventilation holes 30 and shifted to their terminal ends is discharged well to the outside, which is at the negative pressure as described above, from the ventilation openings 55*a*, 55*b* and 55*c* through the first exhaust path 72 described above, as is apparent from FIGS. 8 and 9.

2. Second Embodiment

The second embodiment will be described with reference to FIGS. 11 to 18. The second embodiment can be substantially the same as the first embodiment described above except that (1) a front head side ventilator mechanism 91 is newly added, (2) the practical structure of shutter mechanisms 56 of a back head side ventilator mechanism 8 is different, (3) the practical shape of a ventilation opening forming member 51 serving also as a stabilizer constituting member is slightly different, (4) a pair of left and right ventilation openings 92*a* and 92*b* are newly formed in the lower portion of the occiput region of an outer shell 5, and (5) the arrangements of ventilation openings and ridge grooves formed in the outer shell 5 and in an impact-on-the-head absorbing liner 11 are slightly different. Hence, in the following description, only these differences will be described separately, and a description on portions that are common to the first and second embodiments will be omitted.

(1) Front Head Side Ventilator Mechanism

Figure 12:
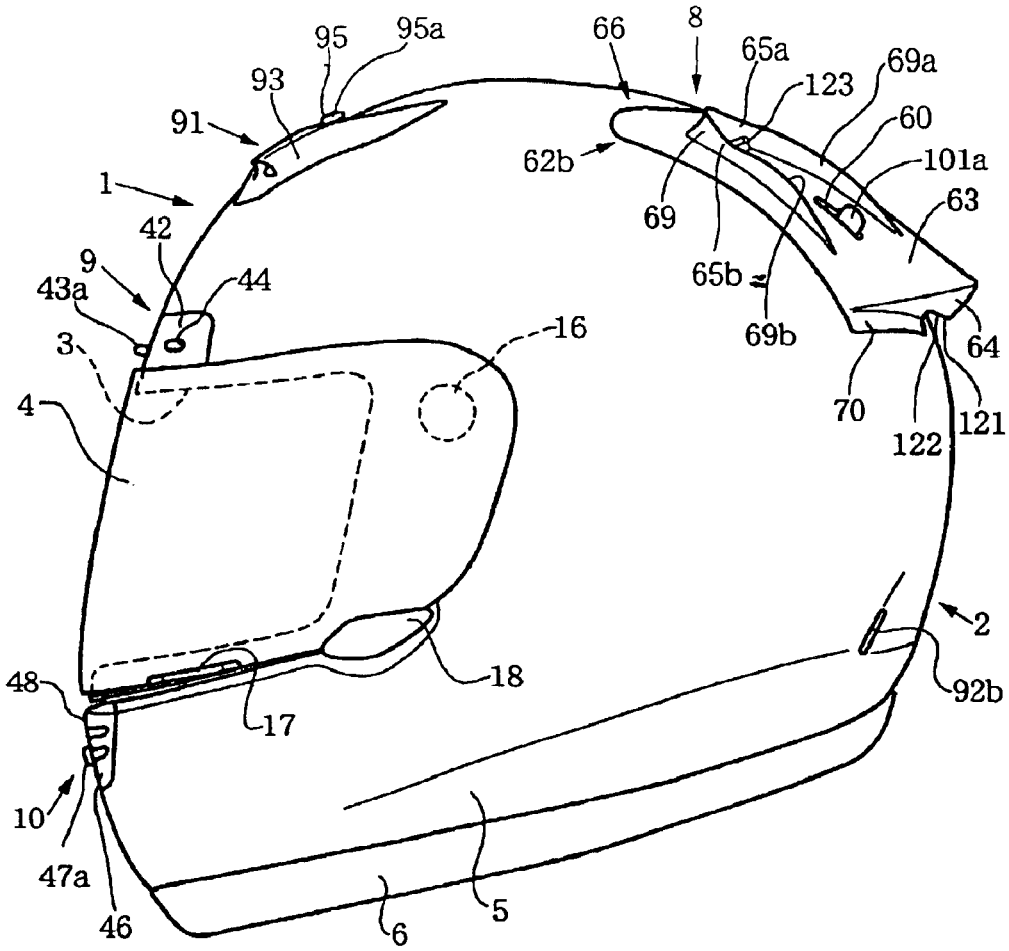
FIG. 12 is a right side view of the helmet of FIG. 11.
Figure 14:
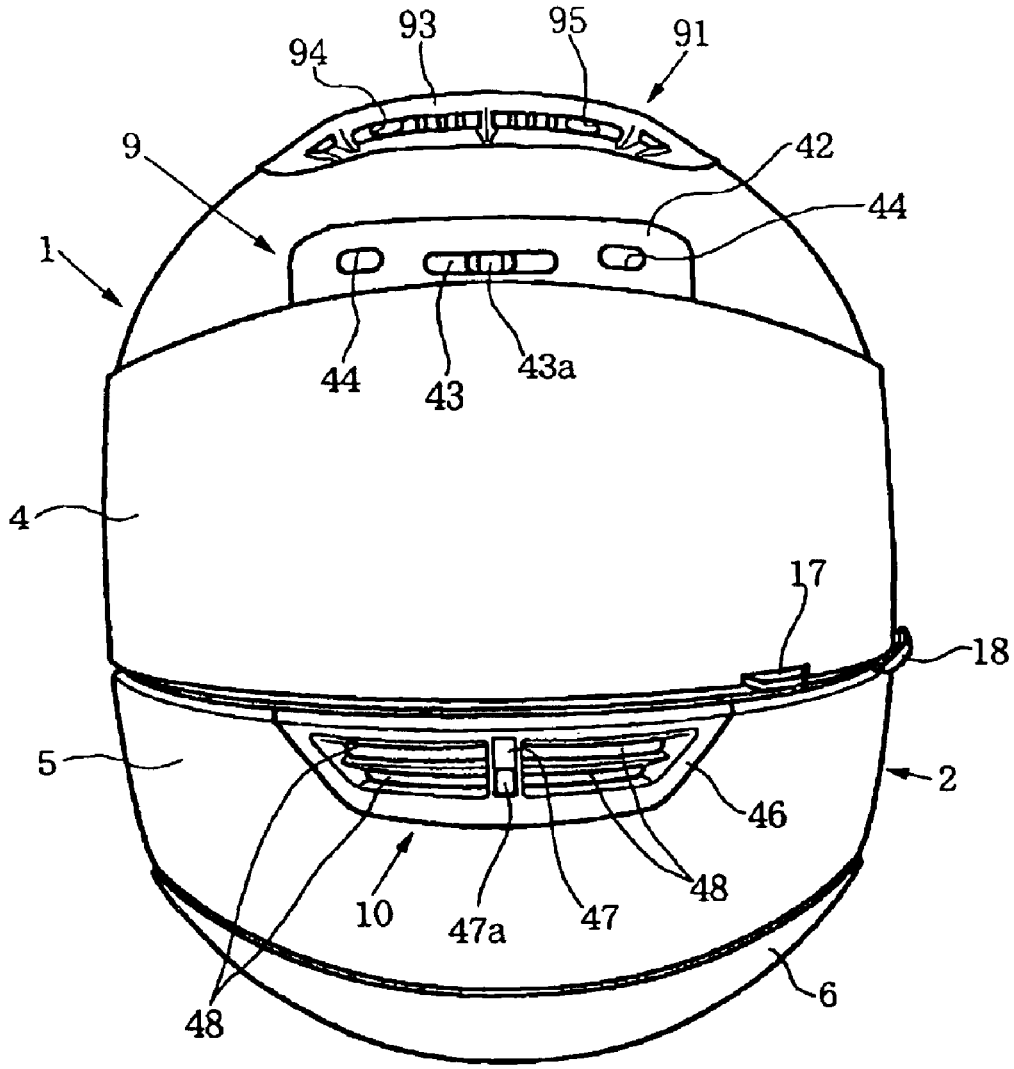
FIG. 14 is a front view of the helmet of FIG. 11.

As shown in FIGS. 12 and 14, the front head side ventilator mechanism 91 is formed at at least part of the upper portion of the sinciput region and the front portion of the vertex region of a head protecting body 2, which respectively correspond to the upper portion of the sinciput part and the front portion of the vertex part of the head of the wearer, and their vicinities. The front head side ventilator mechanism 91 is located at the intermediate portion between a forehead ventilator mechanism 9 and the back head side back head side ventilator mechanism 8 in the back-and-forth direction.

The front head side ventilator mechanism 91 shown in FIGS. 12 and 14 can be basically constituted by a ventilation opening forming member 93 attached to a predetermined region (i.e., at least part of the upper portion of the sinciput region, the front portion of the vertex region and their vicinities) on the outer surface of the outer shell 5 by adhesion or the like, and a shutter member 95 attached to the ventilation opening forming member 93 or outer shell 5 in order to open and close a ventilation opening 94 formed in the ventilation opening forming member 93 or a ventilation opening (not shown) formed in the outer shell 5. When an operating tap 95*a* formed on the shutter member 95 is operated forward and backward, the shielding plate portion of the shutter member 95 opens and closes the ventilation opening 94 or the ventilation opening of the outer shell 5.

The ventilation opening of the outer shell 5 can consist of a pair of left and right ventilation openings. The pair of left and right ventilation openings can communicate with a pair of left and right through holes (not shown) extending to the head accommodating space of the impact-on-the-head absorbing liner 11 through the impact-on-the-head absorbing liner 11 (i.e., an outer auxiliary liner member 23 and main liner member 22). The pair of left and right ventilation openings and the pair of left and right through holes need not communicate with ventilation holes 28 and 30 but can be independent of them. The shutter member 95 can be attached to the outer shell 5 through a shutter attaching member (not shown). In this case, the shutter attaching member can be attached to the outer surface of the outer shell 5 by adhesion or the like, and the shutter member 95 can be attached to the shutter attaching member to be substantially movable forward and backward in the left-to-right direction.

Therefore, while the shutter member 95 of the front head side ventilator mechanism 91 is open and the ventilation opening 94 communicates with the head accommodating space of the impact-on-the-head absorbing liner 11, when the wearer puts on a full-face-type helmet 1 and drives on a motor cycle, the front head side ventilator mechanism 91 operates in the following manner.

More specifically, outer air that has flown relatively to the inside of the ventilation opening forming member 93 from the ventilation opening (i.e., intake opening) 94 of the front head side ventilator mechanism 91 flows relatively into the head accommodating space of the impact-on-the-head absorbing liner 11 from the pair of left and right ventilation openings (i.e., intake ports) formed in the outer shell 5 through the pair of left and right through holes formed in the impact-on-the-head absorbing liner 11.

(2) Shutter Mechanism for Back Head Side Ventilator Mechanism

Figure 13:
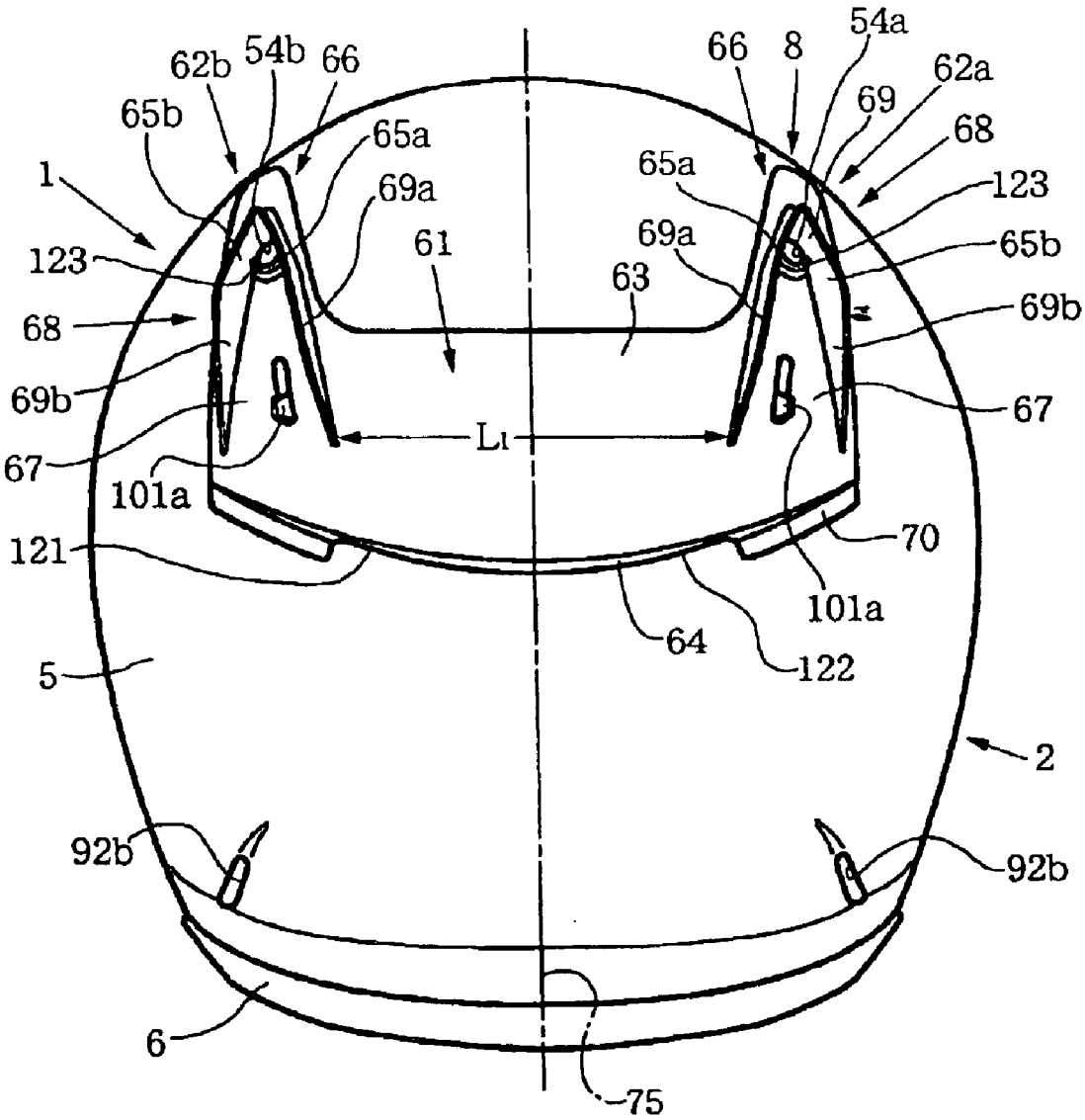
FIG. 13 is a rear view of the helmet of FIG. 11.
Figure 15:
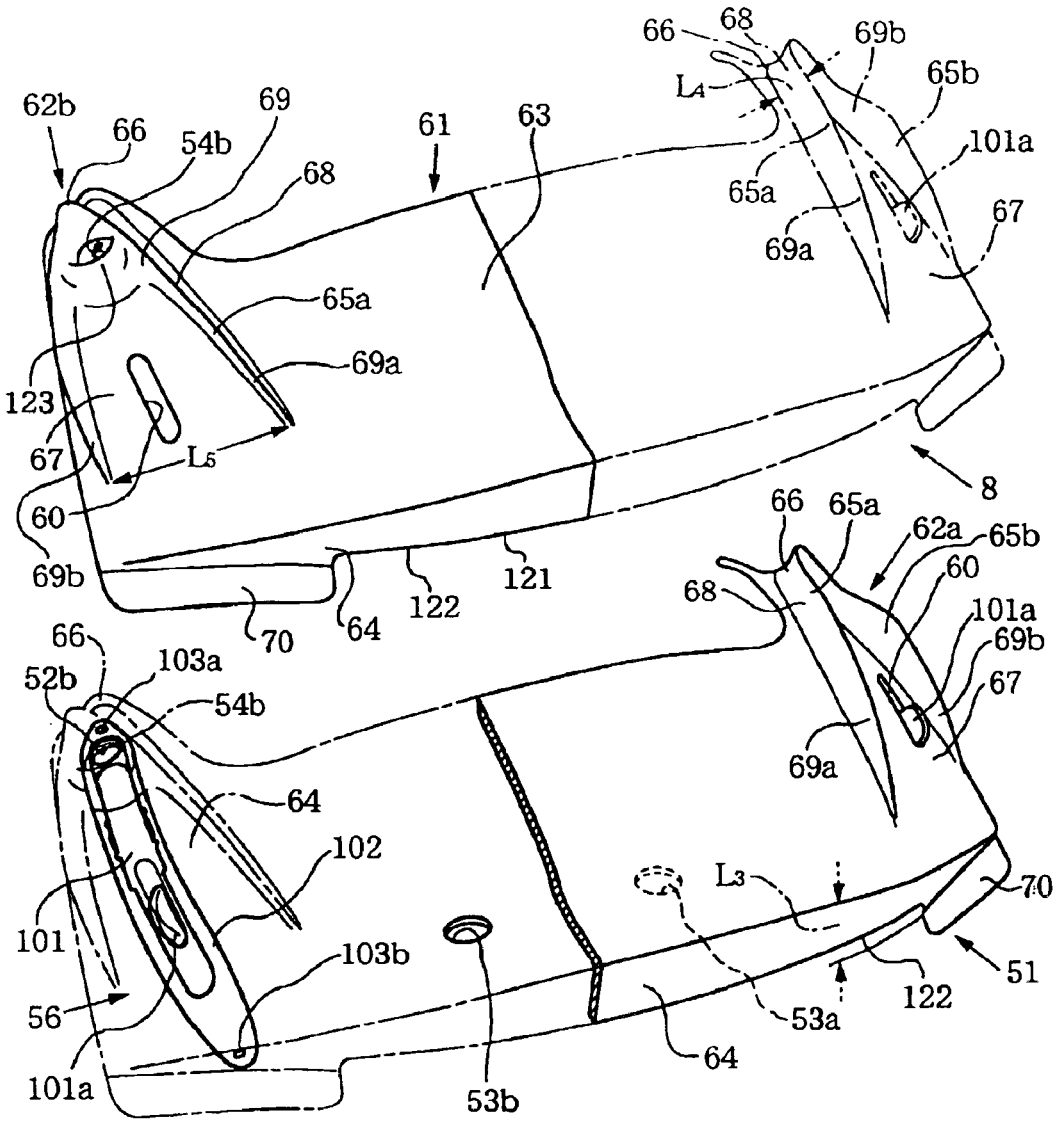
FIG. 15 is a perspective view, seen from obliquely behind the upper right, of a back head side ventilator mechanism of the helmet of FIG. 11, in which a ventilation opening forming member, serving also as a stabilizer constituting member, of the back head side ventilator mechanism is halved and one half is separated.

In the second embodiment, as shown in FIGS. 13 and 15, a pair of left and right shutter mechanisms 56 that can close and open a pair of left and right second exhaust paths 73 are provided. Since no shutter mechanism that can close and open a first exhaust path 72 is provided, the first exhaust path 72 (in other words, a pair of left and right ventilation openings 53*a* and 53*b*) is always open. The ventilation openings 53*a* and 53*b* are covered from the outside with a ventilation opening forming member 51 serving also as a stabilizer constituting member. Hence, rain water or the like hardly enters the outer shell 5 from the ventilation openings 53*a* and 53*b*.

The pair of left and right shutter mechanisms 56 can be axi-symmetric to each other with respect to the center line 75 as an axis of symmetry. Accordingly, in the following description, the right shutter mechanism 56 will be described in detail, and a detailed description on the left shutter mechanism 56 will be omitted.

As shown in FIG. 15, the right shutter mechanism 56 has a shutter member 101 serving also as an operating member, and an attaching member 102 for attaching the shutter member 101 to the outer surface of the outer shell 5 and/or the inner surface of the ventilation opening forming member 51. The right shutter mechanism 56, except for an operating tap 101*a* formed on the shutter member 101, is covered with the ventilation opening forming member 51, the inner periphery of which is attached to the outer surface of the outer shell 5 by adhesion with an adhesive or the like. Therefore, the ventilation opening forming member 51 also serves as a cover member for the pair of left and right shutter mechanisms 56.

Figure 16:
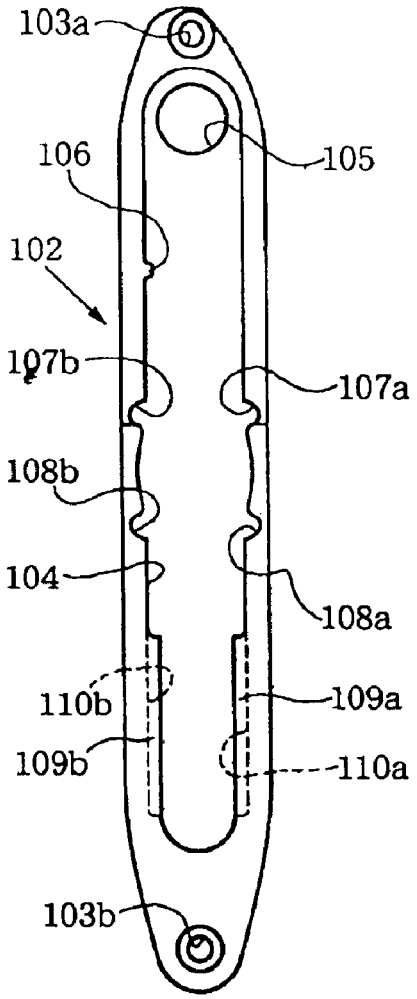
FIG. 16 is a plan view of the attaching member of the shutter mechanism shown in FIG. 15.

As shown in FIGS. 15 and 16, the attaching member 102 can be a longitudinal plate body extending substantially along the longitudinal direction of a V-shaped projecting ridge 66 of the ventilation opening forming member 51. A pair of front and rear through holes 103*a* and 103*b* are formed at the front and rear ends, respectively, of the attaching member 102. The attaching member 102 is fixed to the inner surface of the ventilation opening forming member 51 by screwing with a pair of front and rear attaching screws (not shown) inserted in the through holes 103*a* and 103*b* from their inner sides. In addition to or in place of screwing, the attaching member 102 may be mounted on the outer surface of the outer shell 5 and/or the inner surfaces of the ventilation opening forming member 51 with an adhesive or the like.

As shown in FIG. 16, a recess 104 is formed in the outer surface of the attaching member 102 for accommodating the shutter member 101, except for the operating tap 101*a*, to be slidable forward and backward substantially in the longitudinal direction. A ventilation opening 105 is formed near the front end of the recess 104. The ventilation opening 105 corresponds to a ventilation opening 52*b* of the outer shell 5 and a ventilation opening 54*b* of the ventilation opening forming member 51.

Figure 18:
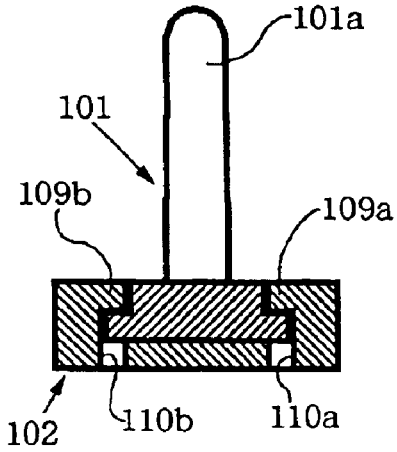
FIG. 18 is a longitudinal sectional view of the shutter mechanism shown in FIG. 15 along an operating tap.

As shown in FIG. 16, the attaching member 102 has, from its front end toward rear end along the recess 104, a projection 106 as a stopper in the forward/backward movement, a pair of left and right notches 107*a* and 107*b* for click in the forward movement, a pair of left and right notches 108*a* and 108*b* for click in the backward movement, and a pair of left and right longitudinal protrusions 109*a* and 109*b*. The protrusions 109*a* and 109*b* project into the recess 104 from its edges. As shown in FIG. 18, a pair of left and right ridge grooves 110*a* and 110*b* are formed in the inner side surface of the attaching member 102 to correspond to the protrusions 109*a* and 109*b*, respectively. Hence, the shutter member 101 is accommodated in the recess 104 of the attaching member 102 such that its pair of left and right target guide portions 111*a* and 111*b* can slide forward and backward along the inner side surfaces of the protrusions 109*a* and 109*b* (in other words, the bottom surfaces of the ridge grooves 110*a* and 110*b*), respectively.

Figure 17:
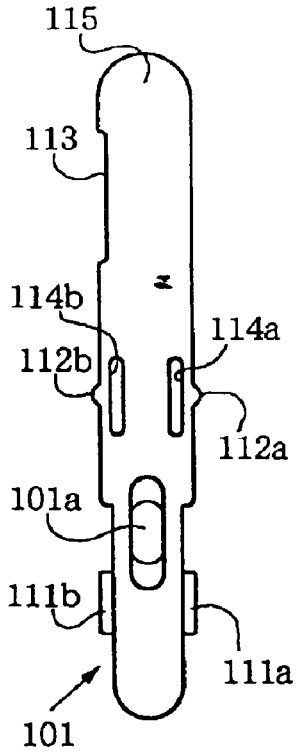
FIG. 17 is a plan view of the shutter member of the shutter mechanism shown in FIG. 15.

As shown in FIG. 17, the shutter member 101 has a pair of left and right projections 112*a* and 112*b* for clicking, to engage with the pair of left and right notches 107*a* and 107*b* in the forward movement and with the pair of left and right notches 108*a* and 108*b* in the backward movement. The shutter member 101 also has a longitudinal notch 113 extending substantially in the longitudinal direction of the shutter member 101, in order to regulate the range of the relative movement of the stopper projection 106 of the attaching member 102 relative to the shutter member 101. Furthermore, in order to impart elasticity to the pair of left and right projections 112*a* and 112*b*, the shutter member 101 has one or a plurality of slits 114*a* and 114*b* which extend substantially in the longitudinal direction between the projections 112*a* and 112*b* and can be through holes.

Therefore, while the ventilation opening 52*b* of the outer shell 5 and the ventilation opening 54*b* of the ventilation opening forming member 51 are open as shown in FIG. 15, when the operating tap 101*a* of the shutter member 101 which is exposed to the outside through an operating tap slit 60 of the ventilation opening forming member 51 is operated in the forward direction, the shutter member 101 moves forward. Thus, a shielding plate portion 115 of the shutter member 101 closes the ventilation opening 52*b* of the outer shell 5 and/or the ventilation opening 54*b* of the ventilation opening forming member 51. Hence, the ventilation opening 52*b* and/or 54*b* changes from the open state to the closed state.

As described above, the ventilation opening 52*b* and/or 54*b* is closed or opened in accordance with the forward or backward movement of the operating tap 101*a*. Thus, the pair of left and right second exhaust paths 73 can be selectively or both closed or opened.

(3) Ventilation Opening Forming Member Serving Also As Stabilizer Constituting Member The connected portion 70 of the ventilation opening forming member 51 serving also as the stabilizer constituting member is notched to leave its left and right ends, as shown in FIG. 15. The ventilation openings 55*a* to 55*c* formed in the step surface 64 of the ventilation opening forming member 51 in the first embodiment described above are omitted. A notch 121 which is long in the left-to-right direction is formed along that end of the step surface 64 which is opposite to an air current deflection surface 63. Hence, as shown in FIGS. 11 to 13 and FIG. 15, a slit 122 serving as an exhaust opening like the ventilation openings 55*a* to 55*c* is formed between that end of the step surface 64 which is opposite to the air current deflection surface 63 and the outer surface of the outer shell 5. According to the second embodiment, the exhaust opening 122 having a large open area can be formed in the step surface 64 with a comparatively simple manufacturing process, and the strength of the step surface 64 (and accordingly of the ventilation opening forming member 51) does not decrease particularly.

Different from the first embodiment described above, a two-way forked projecting ridge 66 of each of a pair of left and right air current divider portions 62*a* and 62*b* of the ventilation opening forming member 51 is formed of a comparatively thin V-shaped band-like portion having substantially the same shape as a V-shaped step surface 69. Hence, a V-shaped peripheral portion 68 of each two-way forked projecting ridge 66 is constituted by the outer peripheral portion of the V-shaped band-like portion, and has substantially the same shape as that of the V-shaped step portion 69 except that the peripheral portion 68 is reversed.

Furthermore, bottom surfaces 67 of the air current divider portions 62*a* and 62*b* have bulges 123 which bulge outwardly in the form of an arc immediately behind ventilation openings 54*a* and 54*b* to surround the ventilation openings 54*a* and 54*b*, respectively.

In item 1(4) (item of "Back Head Side Ventilator Mechanism") described above, concerning the average angle formed by the air current deflection surface 63 and step surface 64, other angles, lengths and width of the first embodiment, the numerical values of the embodiment shown in the drawings, preferable numerical value ranges and more preferable numerical value ranges are described. Such angles, lengths and widths in the second embodiment may differ from those of the first embodiment slightly or to a certain degree, but their preferable numerical value ranges and their more preferable numerical value ranges can be substantially the same as those of the first embodiment described above.

(4) Exhaust Opening in Occiput Region of Outer Shell

Figure 11:
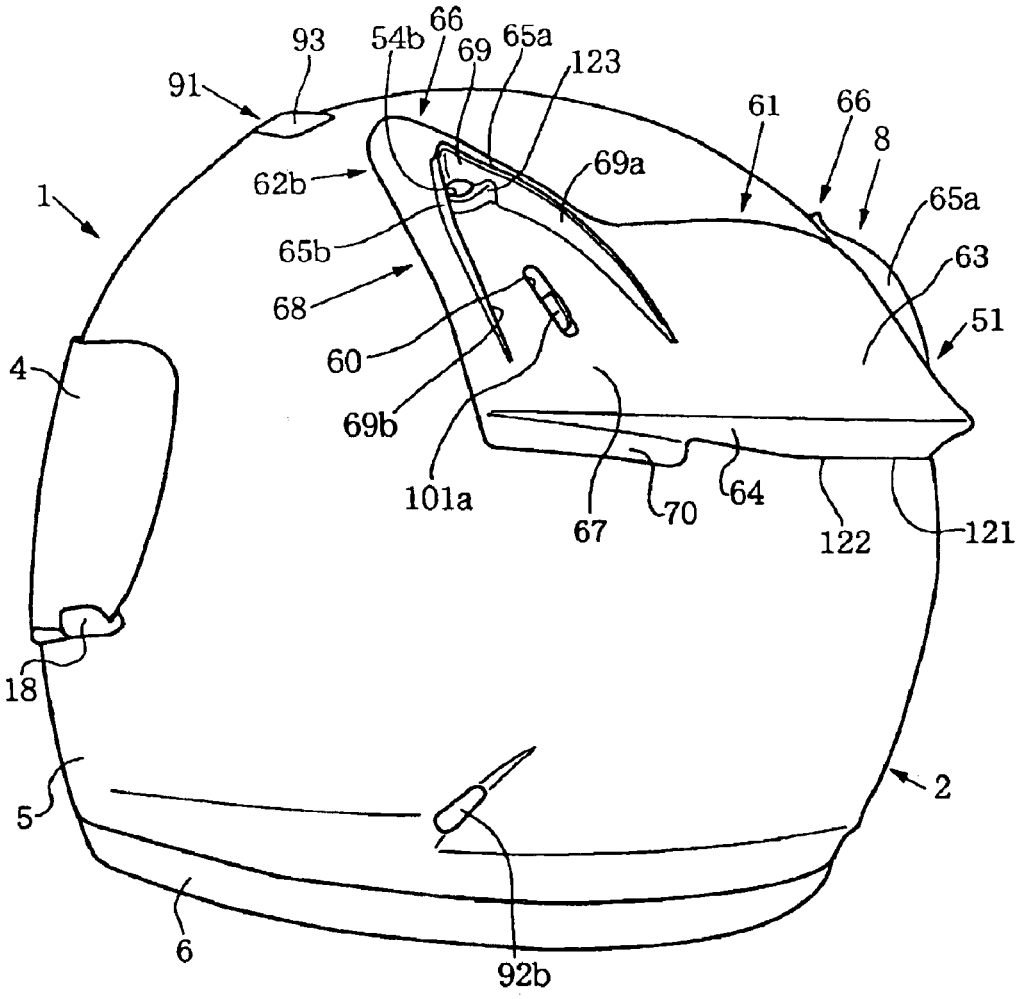
FIG. 11 is a perspective view, seen from obliquely behind the upper right, of the entire portion of a helmet according to the second embodiment in which the present invention is applied to a full-face-type helmet.

As shown in FIGS. 11 to 13, a pair of left and right ventilation openings 92*a* and 92*b* are formed in the lower portion of the occiput region of the outer shell 5. The pair of left and right ventilation openings 92*a* and 92*b* can be slits which are inclined from their upper ends toward their lower ends to the outer left side and outer right side, respectively, and which are formed of through holes. The impact-on-the-head absorbing liner 11 (in other words, the main liner member 22) has a pair of left and right ventilation holes (not shown) to respectively correspond to the ventilation openings 92*a* and 92*b*. These ventilation holes can be substantially horizontal circular through holes which are inclined from the inner surface toward the outer surface of the main liner member 22 slightly downward and slightly backward, respectively. The outer surface of the main liner member 22 which opposes these ventilation holes can be covered with an air-permiable fabric member (not shown) such as a porous unwoven fabric.

Hence, air on the inner side of the impact-on-the-head absorbing liner 11 is discharged to the outside sequentially through the above-mentioned pair of left and right ventilation holes and the pair of left and right ventilation openings 92*a* and 92*b*. Thus, the above-mentioned ventilation holes and the ventilation openings 92*a* and 92*b* serve as exhaust holes and exhaust openings, respectively.

(5) Ventilation Opening and Ridge Groove of Outer Shell and Impact-On-The-Head Absorbing Liner In the second embodiment, as described in the above item (1) (item of "Front Head Side Ventilator Mechanism"), for the sake of the front head side ventilator mechanism 91, a pair of left and right ventilation openings are formed in the outer shell 5, and a pair of left and right through holes communicating with the pair of left and right ventilation openings are formed in the impact-on-the-head absorbing liner 11.

In the second embodiment, for the sake of the forehead ventilator mechanism 9, a ventilation opening 37 is formed in the outer shell 5, and a through hole (not shown) communicating with the ventilation opening 37 is formed in the impact-on-the-head absorbing liner 11 (in other words, main liner member 22). The ventilation opening 37 and the above-mentioned through hole for the forehead ventilator mechanism 9 correspond to the ventilation openings and the through holes for the front head side ventilator mechanism 91, and need not communicate with the ventilation holes 28 and 30, but can be independent of the communication holes 28 and 30.

Furthermore, in the second embodiment, a pair of left and right through holes (not shown) which are not formed in the first embodiment described above are formed in the main liner member 22 so as to communicate with the ventilation holes 28. More specifically, the pair of left and right through holes are formed in the main liner member 22 so as to be continuous to outer ridge grooves 24*a* and 24*b* at locations slightly in front of a pair of left and right through holes 31*a* and 31*b*.

In the second embodiment, different from the first embodiment described above, a pair of left and right inner ridge grooves 26*a* and 26*b* of the main liner member 22 extend long continuously forward to portions where they communicate with a pair of left and right through holes for the front head side ventilator mechanism 91. Different from the first embodiment described above, the pair of left and right outer ridge grooves 24*a* and 24*b* of the main liner member 22 extend continuously to the lower end of the occiput region of the main liner member 22. A pair of left and right through holes 25*a* and 25*b* of the main liner member 22 are formed at portions slightly in front of the terminal ends of the pair of left and right outer ridge grooves 24*a* and 24*b*. The through holes 25*a* and 25*b* do not communicate with the ridge grooves 26*a* and 26*b* on the inner surface of the main liner member 22, but are independent of the inner ridge grooves 26*a* and 26*b*.

3. Third Embodiment

The third embodiment will be described with reference to FIG. 19. The third embodiment can be substantially the same as the first embodiment described above except that the practical structure of a shutter mechanism 56 of a back head side ventilator mechanism 8 is different and accordingly the practical shape of a ventilation opening forming member 51 serving also as a stabilizer constituting member is slightly different. Hence, in the following description, only these differences will be described, and a description on portions that are common to the first and third embodiments will be omitted.

The shutter mechanism 56 can close or open all of a pair of left and right ventilation openings 52*a* and 52*b* and a pair of left and right ventilation openings 53*a* and 53*b* simultaneously by moving a single operating tap 131*a* of a single operating member 131 forward and backward. The shutter mechanism 56 has the single operating member 131, an attaching plate or attaching member (i.e., the auxiliary plate described above) 132, with which the operating member 131 is attached to an outer shell 5, and a pair of left and right auxiliary shutter members 133*a* and 133*b*.

The operating member 131 serves also as a main shutter member, and has a pair of left and right shielding plate portions 134*a* and 134*b* projecting forward, and the operating tap 131*a* projecting backward. The operating member 131 has a pair of left and right guide slits 135*a* and 135*b* extending substantially along the left-to-right direction, a guide slit 136 with a position holding function formed between the slits 135*a* and 135*b* and extending substantially along the left-to-right direction, and an auxiliary slit 137 extending between the slit 136 and operating tap 131*a* substantially along the left-to-right direction. An elastic deformable portion 138 curved toward the slit 136 is formed between the guide slit 136 with the position holding function and the auxiliary slit 137. Hence, the guide slit 136 has a function of holding in position a guide projection 142 (to be described later).

The attaching plate 132 is attached to the outer surface of the outer shell 5 by, e.g., adhesion with an adhesive. The attaching plate 132 has a pair of left and right guide projections 151*a* and 151*b* which oppose the pair of left and right guide slits 135*a* and 135*b*, respectively, and the guide projection 142 with the position holding function which opposes the slit 136. The guide projection 142 has a groove 142*a* extending substantially along the direction of forward/backward movement of an operating member 131. Hence, the guide projection 142 itself has elasticity, and accordingly a position holding function. The guide projections 151*a*, 151*b* and 142 are inserted in the slits 135*a*, 135*b* and 136, respectively, so as to slidable relative to them.

A portion near one end of each of the pair of left and right auxiliary shutter members 133*a* and 133*b* is pivotally axially supported near the corresponding one of the left and right ends of the operating member 131 by a corresponding one of shafts 143*a* and 143*b*. The auxiliary shutter members 133*a* and 133*b* can be elongated plate bodies which are substantially curved forward like arcs.

A pair of left and right slits 144*a* and 144*b* are formed in the operating member 131 in the vicinities of the shafts 143*a* and 143*b*, respectively. The guide slits 144*a* and 144*b* form substantially arcs about the shafts 143*a* and 143*b* as the centers, respectively. Guide projections 145*a* and 145*b* formed on the pair of left and right auxiliary shutter members 133*a* and 133*b* are inserted in the arcuate slits 144*a* and 144*b*, respectively, such that they can slide relative to them.

The outer shell 5 has left and right pairs of support rods 146*a* and 147*a*, and 146*b* and 147*b* for supporting the pair of left and right auxiliary shutter members 133*a* and 133*b*, such that they oppose the intermediate portions of the auxiliary shutter members 133*a* and 133*b*, respectively. The support rods 146*a* and 147*a*, and 146*b* and 147*b* oppose each other at distances substantially corresponding to the widths of the intermediate portions of the auxiliary shutter members 133*a* and 133*b*, respectively. The opposing surfaces of the support rods 146*a* and 147*a*, and 146*b* and 147*b* form substantially semicircular cylindrical convex surfaces.

Shielding plate portions 148*a* and 148*b* are formed at the free ends of the auxiliary shutter members 133*a* and 133*b* to correspond to the ventilation openings 52*a* and 52*b*, respectively, of the outer shell 5. A ventilation opening 149 is formed in the auxiliary shutter member 133*b* to be adjacent to the shielding plate portion 148*b*. When the auxiliary shutter member 133*b* moves backward to the open state position, the ventilation opening 149 overlaps the ventilation opening 52*b* of the outer shell 5 to open it, as shown in FIG. 19.

The distance between the inner surface of the ventilation opening forming member 51 (but near the outer periphery of the ventilation opening 52*b*) and the outer surface of the outer shell 5 can be set to substantially coincide with the thickness of that portion of the auxiliary shutter member 133*b* which is near the outer periphery of the ventilation opening 149. In this case, the second exhaust path 73 on the right side described in the above item 1(4) (item of "Back Head Side Ventilator Mechanism") is comprised of only the right ventilation opening 52*b*, ventilation opening 149, and right ventilation opening 54*b*. Thus, air flowing in this second exhaust path 73 will not undesirably diffuse in a ventilation space 71. Note that a second exhaust path 73 on the left side can have the same arrangement as this. In this case, the free end of the left auxiliary shutter member 133*a* may be extended from the shielding plate portion 148*a* to form an extension 150, as indicated by a chain line in FIG. 19, and a ventilation opening 151 may be formed in the extension 150 to correspond to the ventilation opening 149.

The ventilation opening forming member 51 in the third embodiment can be substantially the same as the ventilation opening forming member 51 of the first embodiment described above, except that a slit 139 for the operating tap 131*a* is formed, in place of a pair of left and right operating tap slits 60, in a step surface 64 between ventilation openings 55*a*, 55*b* and 55*c*, and a connecting portion 70.

Figure 19:
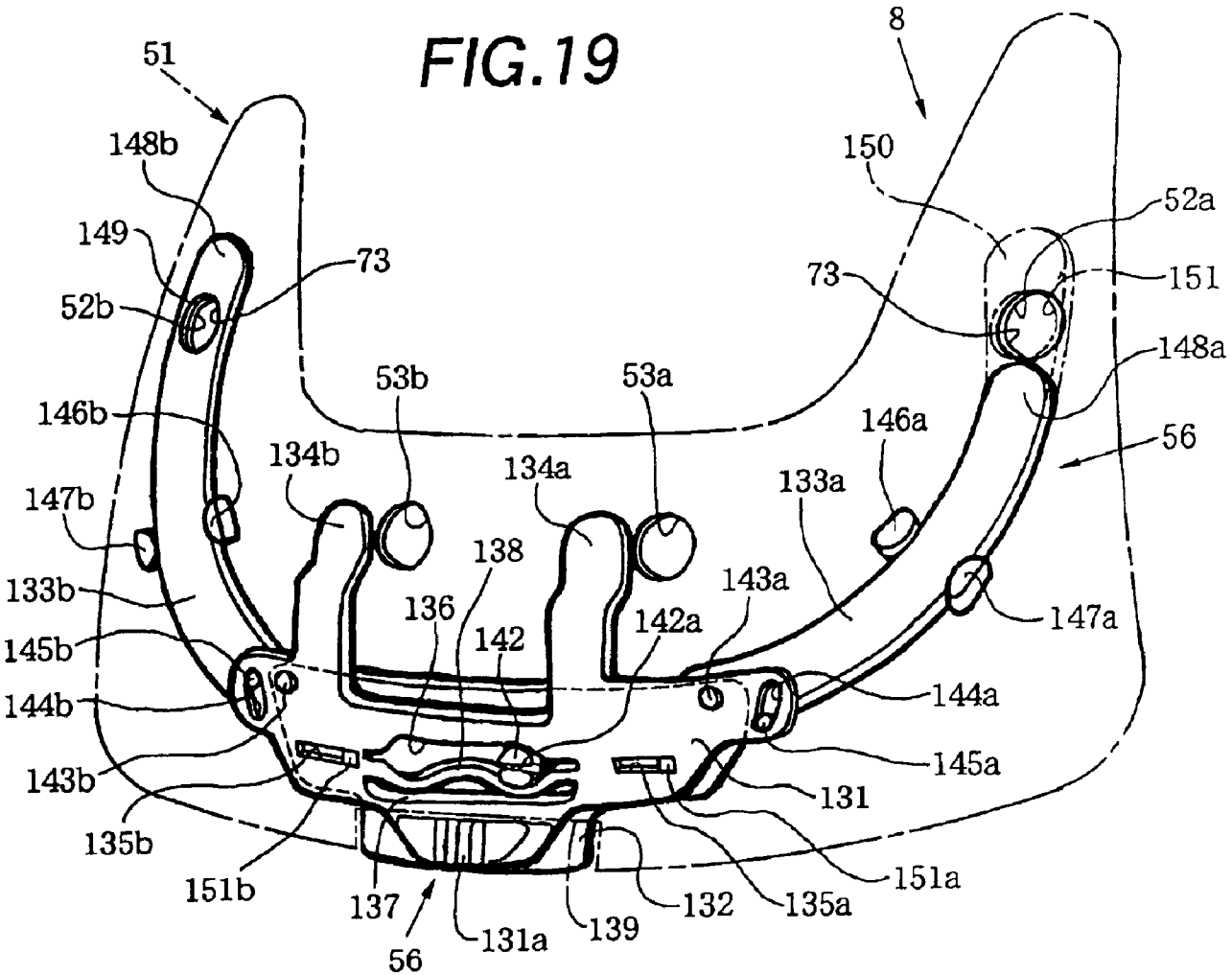
FIG. 19 is a perspective view, seen from the left, of a back head side ventilator mechanism in the third embodiment in which the present invention is applied to a full-face-type helmet, where a ventilation opening forming member, serving also as a stabilizer constituting member, is indicated by an imaginary line.

Therefore, while the ventilation openings 52*a*, 52*b*, 53*a* and 53*b* of the outer shell 5 are open as shown in FIG. 19, when the operating tap 131*a* of the operating member 131 which is exposed to the outside through the operating tap slit 139 of the ventilation opening forming member 51 is moved forward to the left (right in FIG. 19), the main shutter member 131 serving also as the operating member moves forward to the left because of the guide function of the linear forward/backward movement of the guide slits 135*a*, 135*b* and 136 and the guide projections 151*a*, 151*b* and 142. Hence, the shielding plate portions 134*a* and 134*b* of the main shutter member 131 close the ventilation openings 53*a* and 53*b* of the outer shell 5 from the outer surface. Accordingly, the ventilation openings 53*a* and 53*b* change from the open state to the closed state. When the main shutter member 131 moves forward, the auxiliary shutter members 133*a* and 133*b* pivot slightly clockwise and counterclockwise, respectively, in FIG. 19 about the shafts 143*a* and 143*b* as the fulcrums while they are being supported at their intermediate portions by the support rods 146*a* and 147*a* and 146*b* and 147*b* and being guided by the guide slits 144*a* and 144*b* and guide projections 145*a* and 145*b*. Accordingly, the shielding plate portions 148*a* and 148*b* of the auxiliary shutter members 133*a* and 133*b* close the ventilation openings 52*a* and 52*b*, respectively, of the outer shell 5 from their outer surfaces. As a result, the ventilation openings 52*a* and 52*b* change from the open state to the closed state.

As described above, the ventilation openings 52*a*, 52*b*, 53*a* and 53*b* are closed or opened simultaneously in accordance with the forward/backward operation of the single operating tap 131*a*. Therefore, the first exhaust path 72 and the pair of left and right second exhaust paths 73 can all be closed or opened simultaneously.

The third embodiment described above is substantially the same as the first embodiment described above, except that the shutter mechanism 56 of the back head side ventilator mechanism 8 has a different practical structure and accordingly the ventilation opening forming member 51 serving also as the stabilizer constituting member has a slightly different practical shape. However, the third embodiment described above can be substantially the same as the second embodiment described above, except that the shutter mechanism 56 of the back head side ventilator mechanism 8 has a different practical structure and accordingly the ventilation opening forming member 51 serving also as the stabilizer constituting member has a slightly different practical shape.

So far the first, second and third embodiments of the present invention have been described in detail. The present invention is not limited to these embodiments, and various types of changes and modifications can be made on the basis of the spirit of the invention described in claims.

For example, in the above embodiments, the single stabilizer portion 61 serving also as the ventilation opening forming portion is formed at the central portion in the left-to-right direction of the ventilation opening forming member 51 serving also as the stabilizer constituting member, and the pair of left and right air current divider portions 62*a* and 62*b* are formed on the two sides in the left-to-right direction of the ventilation opening forming member 51. Conversely, a single air current divider portion may be formed at the central portion in the left-to-right direction of the ventilation opening forming member 51 serving also as the stabilizer constituting member, and a pair of left and right stabilizer portions serving also as ventilation opening forming members may be formed on the two sides in the left-to-right direction of the ventilation opening forming member 51.

In the above embodiments, the pair of left and right ventilation holes 30 formed between the outer surface 23*b* of the impact-on-the-head absorbing liner 11 and the inner surface of the outer shell 5 communicate with the first exhaust path 72, and the pair of left and right ventilation holes 28 formed between the main liner member 22 and outer auxiliary liner member 23, and the left and right pairs of through holes 31*a* and 31*b*, and 32*a* and 32*b* of the impact-on-the-head absorbing liner 11 communicate with the pair of left and right second exhaust paths 73. Conversely, the pair of left and right ventilation holes 30 may communicate with the pair of left and right second exhaust paths 73, and the pair of left and right ventilation holes 28 and the left and right pairs of through holes 31*a* and 31*b*, and 32*a* and 32*b* may respectively communicate with the first exhaust path 72.

In the above embodiments, the step surface 64 of the stabilizer 61 serving also as the ventilation opening forming member extends from the rear end of the air current deflection surface 63 substantially toward the outer surface of the outer shell 5. However, it suffices if the step surface 64 extends from the vicinity of the rear end of the air current deflection surface 63 substantially toward the outer surface of the outer shell 5. For example, in the state shown in FIG. 5, the air current deflection surface 63 may project like eaves over the step surface 64.

In the above embodiments, the substantially V-shaped projecting ridge 66 is formed on each of the pair of left and right air current divider portions 62*a* and 62*b*. The projecting ridge 66 need not have a substantially V shape, but may have another substantially two-way forked shape such as a substantially U shape. The preferable numerical value ranges and more preferable numerical value ranges already described concerning the substantially V-shaped projecting ridge 66 substantially apply to a case wherein the projecting ridge 66 has another such substantially two-way forked shape.

In the above embodiments, the ventilation openings 52*a* and 52*b*, and 53*a* and 53*b* formed in the outer shell 5 are closed by the shutter mechanism or mechanisms 56, so that the first exhaust path 72 and the pair of left and right second exhaust paths 73 are closed by the shutter mechanism or mechanisms 56. However, this arrangement is not always necessary. For example, the ventilation openings 54*a* and 54*b*, and 55*a* to 55*c* formed in the ventilation opening forming member 51 may be closed by the shutter mechanism or mechanisms 56.

In the above embodiments, the present invention is applied to the full-face-type helmet 1. The present invention can also be applied to other types of helmets such as a jet-type helmet, a semi-jet-type helmet or a full-face-type helmet serving also as a jet-type helmet, the chin portion of which can be raised.

What is claimed is:

1. A helmet comprising a head protecting body to be worn on a head of a helmet wearer, said head protecting body having a ventilator mechanism, wherein a stabilizer constituting member having a stabilizer portion is disposed on an outer side of said head protecting body, said stabilizer portion having an air current deflection surface which gradually separates from an outer surface of said head protecting body in a range of a front end to a rear end of said stabilizer portion, and a step surface extending from near the rear end of said air current deflection surface substantially toward said outer surface of said head protecting body, and a ventilation opening serving as an exhaust opening of said ventilation mechanism is formed in said step surface.

2. A helmet according to claim 1, wherein a notch extending long in a left-to-right direction along that end of said step surface which is opposite to said air current deflection surface is formed in said stabilizer constituting member, and a slit formed by said notch between that end of said step surface, which is opposite to said air current deflection surface, and said outer surface of said head protecting body forms said ventilation opening.

3. A helmet according to claim 1, wherein an average angle formed by said air current deflection surface and said step surface falls within a range of 45° to 120°.

4. A helmet according to claim 3, wherein an average length of said air current deflection surface in a left-to-right direction falls within a range of 60 mm to 240 mm, and an average length in a back-and-forth direction of said air current deflection surface falls within a range of 30 mm to 120 mm.

5. A helmet according to claim 4, wherein an average width of said step surface in a direction substantially perpendicular to a left-to-right direction falls within a range of 4 mm to 26 mm.

6. A helmet according to claim 1, wherein said stabilizer constituting member is formed at at least a part of a region comprising a vertex region of said head protecting body which opposes a vertex part of the head of the helmet wearer, an upper portion of an occiput region of said head protecting body which opposes an upper portion of an occiput part of the head of the helmet wearer, and vicinities of said vertex region and of said upper portion of said occiput region of said head protecting body.

7. A helmet according to claim 6, wherein in addition to said ventilator mechanism, a chin ventilator mechanism, a forehead ventilator mechanism, and a front head side ventilator mechanism are provided to said head protecting body, said front head side ventilator mechanism being arranged at an intermediate portion in a back-and-forth direction between said forehead ventilator mechanism and said ventilator mechanism, and said chin ventilator mechanism, said forehead ventilator mechanism, and said front head side ventilator mechanism respectively having ventilation openings serving as intake openings.

8. A helmet comprising a head protecting body to be worn on a head of a helmet wearer, said head protecting body having a ventilator mechanism, wherein a stabilizer constituting member commonly having a stabilizer portion and an air current divider portion provided independently of said stabilizer portion is disposed on an outer side of said head protecting body, said stabilizer portion having an air current deflection surface which gradually separates from an outer surface of said head protecting body in a range of a front end to a rear end of said stabilizer portion, and said air current divider portion having a substantially two-way forked projecting ridge, and a ventilation opening which is surrounded by the substantially two-way forked projecting ridge and serves as an exhaust opening of said ventilator mechanism.

9. A helmet according to claim 8, wherein said stabilizer portion further has a step surface extending from near a rear end of said air current deflection surface substantially toward said outer surface of said head protecting body, and a second ventilation opening serving as a second exhaust opening of said ventilator mechanism is formed in said step surface.

10. A helmet according to claim 9, wherein first and second ventilation openings are formed in an outer shell of said head protecting body, and said helmet further comprises at least one first exhaust path extending from said first ventilation opening of said outer shell to said second ventilation opening of said step surface, and at least one second exhaust path extending from said second ventilation opening of said the outer shell to said ventilation opening of said air current divider portion, and a shutter mechanism which can commonly open and close at least one of said first exhaust path and at least one of said second exhaust path.

11. A helmet according to claim 10, wherein said first exhaust path comprises a pair of left and right first exhaust paths and said second exhaust path comprises a pair of left and right second exhaust paths, and said shutter mechanism can commonly open and close said pair of left and right first exhaust paths and said pair of left and right second exhaust paths.

12. A helmet according to claim 9, wherein first and second ventilation openings are formed in an outer shell of said head protecting body, and said helmet further comprises a first exhaust path extending from said first ventilation opening of said outer shell to said second ventilation opening of said step surface, and a second exhaust path extending from said second ventilation opening of said outer shell to said ventilation opening of said air current divider portion, and no shutter mechanism that can open and close said first exhaust path, but a shutter mechanism that can open and close the second exhaust path.

13. A helmet according to claim 9, wherein a notch extending long in a left-to-right direction along that end of said step surface which is opposite to said air current deflection surface is formed in said stabilizer constituting member, and a slit formed by said notch between that end of said step surface, which is opposite to said air current deflection surface, and said outer surface of said head protecting body forms said second ventilation opening.

14. A helmet according to claim 9, wherein an average angle formed by said air current deflection surface and said step surface falls within a range of 45° to 120°.

15. A helmet according to claim 8, wherein an average length of said air current deflection surface in a left-to-right direction falls within a range of 60 mm to 240 mm, and an average length in a back-and-forth direction of said air current deflection surface falls within a range of 30 mm to 120 mm.

16. A helmet according to claim 9, wherein an average width of said step surface in a direction substantially perpendicular to a left-to-right direction falls within a range of 4 mm to 26 mm.

17. A helmet according to claim 8, wherein a length of each of a pair of step surface portions of a substantially two-way forked step surface formed on said substantially two-way forked projecting ridge falls within a range of 30 mm to 200 mm, an average angle formed by said pair of step surface portions of said substantially two-way forked step surface falls within a range of 15° to 60°, and a width of said substantially two-way forked step surface around said ventilation opening falls within a range of 2.5 mm to 16 mm.

18. A helmet according to claim 8, wherein said stabilizer constituting member is formed at at least a part of a region comprising a vertex region of said head protecting body which opposes a vertex part of the head of the helmet wearer, an upper portion of an occiput region of said head protecting body which opposes an upper portion of an occiput part of the head of the helmet wearer, and vicinities of said vertex region and of said upper portion of said occoput region of said head protecting body.

19. A helmet according to claim 18, wherein in addition to said ventilator mechanism, a chin ventilator mechanism, a forehead ventilator mechanism, and a front head side ventilator mechanism are provided to said head protecting body, said front head side ventilator mechanism being arranged at an intermediate portion in a back-and-forth direction between said forehead ventilator mechanism and said ventilator mechanism, and said chin ventilator mechanism, said forehead ventilator mechanism, and said front head side ventilator mechanism respectively having ventilation openings serving as intake openings.

20. A helmet comprising a head protecting body to be worn on a head of a helmet wearer, said head protecting body having a ventilator mechanism, wherein a ventilation opening forming member commonly having a ventilation opening forming portion and an air current divider portion provided independently of said ventilation opening forming portion is disposed on an outer side of said head protecting body, said ventilation opening forming portion having an air current deflection surface which gradually separates from an outer surface of said head protecting body in a range of a front end to a rear end of said ventilation opening forming portion, and a step surface extending from near the rear end of said air current deflection surface substantially toward said outer surface of said head protecting body, and said air current divider portion having a substantially two-way forked projecting ridge, and a ventilation opening which is surrounded by the substantially two-way forked projecting ridge and serves as an exhaust opening of said ventilator mechanism, and a second ventilation opening serving as a second exhaust opening of said ventilator mechanism is formed in said step surface.

21. A helmet according to claim 20, wherein first and second ventilation openings are formed in an outer shell of said head protecting body, and said helmet further comprises at least one first exhaust path extending from said first ventilation opening of said outer shell to said second ventilation opening of said step surface, and at least one second exhaust path extending from said second ventilation opening of said outer shell to said ventilation opening of said air current divider portion, and a shutter mechanism which can commonly open and close said at least one of said first exhaust path and at least one of said second exhaust path.

22. A helmet according to claim 21, wherein said first exhaust path comprises a pair of left and right first exhaust paths and said second exhaust path comprises a pair of left and right second exhaust paths, and said shutter mechanism can commonly open and close said pair of left and right first exhaust paths and said pair of left and right second exhaust paths.

23. A helmet-according to claim 20, wherein first and second ventilation openings are fanned in an outer shell of said head protecting body, and said helmet further comprises a first exhaust path extending from said first ventilation opening of said outer shell to said second ventilation opening of said step surface, and a second exhaust path extending from said second ventilation opening of said outer shell to said ventilation opening of said air current divider portion, and no shutter mechanism that can open and close said first exhaust path, but a shutter mechanism that can open and close the second exhaust path.

24. A helmet according to claim 20, wherein a notch extending long in a left-to-right direction along that end of said step surface which is opposite to said air current deflection surface is formed in said ventilation opening forming member, and a slit formed by said notch between that end of said step surface, which is opposite to said air current deflection surface, and said outer surface of said head protecting body forms said second ventilation opening.

25. A helmet according to claim 20, wherein an average angle formed by said air current deflection surface and said step surface falls within a range of 45° to 120°.

26. A helmet according to claim 25, wherein an average length of said air current deflection surface in a left-to-right direction falls within a range of 60 mm to 240 mm, and an average length in a back-and-forth direction of said air current deflection surface falls within a range of 30 mm to 120 mm.

27. A helmet according to claim 26, wherein an average width of said step surface in a direction substantially perpendicular to a left-to-right direction falls within a range of 4 mm to 26 mm.

28. A helmet according to claim 27, wherein a length of each of a pair of step surface portions of a substantially two-way forked step surface formed on said substantially two-way forked projecting ridge falls within a range of 30 mm to 200 mm, an average angle formed by said pair of step surface portions of said substantially two-way forked step surface falls within a range of 15° to 60°, and a width of said substantially two-way forked step surface around said ventilation opening falls within a range of 2.5 mm to 16 mm.

29. A helmet according to claim 20, wherein said ventilation opening forming member is formed-at at least a part of a region comprising a vertex region of said head protecting body which opposes a vertex part of the occiput of the helmet wearer, an upper portion of an occiput region of said head protecting body which opposes an upper portion of an occiput part of the head of the helmet wearer, and vicinities of said vertex region and of said upper portion of said occiput region of said head protecting body.

30. A helmet according to claim 29, wherein in addition to said ventilator mechanism, a chin ventilator mechanism, a forehead ventilator mechanism, and a front head side ventilator mechanism are provided to said head protecting body, said front head side ventilator mechanism being arranged at an intermediate portion in a back-and-forth direction between said forehead ventilator mechanism and said ventilator mechanism, and said chin ventilator mechanism, said forehead ventilator mechanism, and said front head side ventilator mechanism respectively having ventilation openings serving as intake openings.

31. A helmet according to claim 1 wherein an average angle formed by said air current deflection surface and said step surface falls within a range of 60° to 100°.

32. A helmet according to claim 31 wherein an average length of said air current deflection surface in a left-to-right direction falls within a range of 80 mm to 180 mm, and an average length in a back-and-forth direction of said air current deflection surface falls within a range of 40 mm to 90 mm.

33. A helmet according to claim 32 wherein an average width of said step surface in a direction substantially perpendicular to a left-to-right direction falls within a range of 6 mm to 18 mm.

34. A helmet according to claim 9 wherein an average angle formed by said air currect deflection surface and said step surface falls within a range of 60° to 100°.

35. A helmet according to claim 8 wherein an average length of said air current deflection surface in a left-to-right direction falls within a range of 80 mm to 180 mm, and an average length in a back-and-forth direction of said air current deflection surface falls within a range of 40 mm to 90 mm.

36. A helmet according to claim 9 wherein an average width of said step surface in a direction substantially perpendicular to a left-to-right direction falls within a range of 6 mm to 18 mm.

37. A helmet according to claim 8, wherein a length of each of a pair of step surface portions of a substantially two-way forked step surface formed on said substantially two-way forked projecting ridge falls within a range of 40 mm to 160 mm, an average angle formed by said pair of step surface portions of said substantially two-way forked step surface falls within a range of 20°to 50°, and a width of said substantially two-way forked step surface around said ventilation opening falls within a range of 4.5 mm to 12 mm.

38. A helmet according to claim 20 wherein an average angle formed by said air current deflection surface and said step surface falls within a range of 60° to 100°.

39. A helmet according to claim 38 wherein an average length of said air current deflection surface in a left-to-right direction falls within a range of 80 mm to 180 mm, and an average length in a back-and-forth direction of said air current deflection surface falls within a range of 40 mm to 90 mm.

40. A helmet according to claim 39 wherein an average width of said step surface in a direction substantially perpendicular to a left-to-right direction falls within a range of 6 mm to 18 mm.

41. A helmet according to claim 40 wherein a length of each of a pair of step surface portions of a substantially two-way forked step surface formed on said substantially two-way forked projecting ridge falls within a range of 40 mm to 160 mm, an average angle formed by said pair of step surface portions of said substantially two-way forked step surface falls within a range of 20° to 50°, and a width of said substantially two-way forked step surface around said ventilation opening falls within a range of 4.5 mm to 12 mm.

* * * * *